US008913945B2

(12) United States Patent
Kojima et al.

(10) Patent No.: US 8,913,945 B2
(45) Date of Patent: Dec. 16, 2014

(54) CLEANING BLADE, CLEANING DEVICE, PROCESS CARTRIDGE, AND IMAGE FORMING APPARATUS

(71) Applicant: Fuji Xerox Co., Ltd., Tokyo (JP)

(72) Inventors: Noriaki Kojima, Kanagawa (JP); Yoshinori Takahashi, Kanagawa (JP); Kei Tanaka, Kanagawa (JP); Tsutomu Sugimoto, Kanagawa (JP); Daisuke Tano, Kanagawa (JP); Masato Ono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 46 days.

(21) Appl. No.: 13/839,217

(22) Filed: Mar. 15, 2013

(65) Prior Publication Data

US 2014/0086655 A1 Mar. 27, 2014

(30) Foreign Application Priority Data

Sep. 25, 2012 (JP) ..... 2012-210548

(51) Int. Cl.
*G03G 21/00* (2006.01)

(52) U.S. Cl.
CPC ..... *G03G 21/0011* (2013.01)
USPC ..... 399/350; 15/256.5

(58) Field of Classification Search
CPC ..... G03G 21/0011; G03G 21/0017; G03G 2221/0005
USPC ..... 399/350; 430/125.31, 126.2; 15/256.5, 15/256.51, 256.52
See application file for complete search history.

(56) References Cited

U.S. PATENT DOCUMENTS

| | | | | |
|---|---|---|---|---|
| 2006/0216084 | A1* | 9/2006 | Kojima et al. | 399/350 |
| 2010/0166472 | A1* | 7/2010 | Kato | 399/350 |
| 2011/0229233 | A1* | 9/2011 | Watanabe et al. | 399/350 |
| 2014/0086654 | A1* | 3/2014 | Kojima | 399/350 |

FOREIGN PATENT DOCUMENTS

| | | | |
|---|---|---|---|
| JP | A-2001-343874 | | 12/2001 |
| JP | A-2004-287102 | | 10/2004 |
| JP | A-2006-235022 | | 9/2006 |
| JP | 2010-014984 | A * | 1/2010 |

* cited by examiner

*Primary Examiner* — Sophia S Chen
(74) *Attorney, Agent, or Firm* — Oliff PLC

(57) ABSTRACT

Provided is a cleaning blade in which at least a portion which comes in contact with a member to be cleaned is configured of a member having dynamic ultra micro hardness of from 0.25 to 0.65 and an index K acquired in the following Equation (1) of equal to or more than 15:

index $K$=[23° C. breaking elongation (%)]×[10° C. impact resilience (%)]×(−1)×[tan δ peak temperature (° C.)]/[Young's modulus (MPa)]/1000 Equation (1).

7 Claims, 20 Drawing Sheets

CLEANING BLADE, CLEANING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-210548 filed Sep. 25, 2012.

BACKGROUND

1. Technical Field

The present invention relates to a cleaning blade, a cleaning device, a process cartridge, and an image forming apparatus.

2. Related Art

In the related art, in a copier, a printer, a facsimile and the like of an electrophotographic method, a cleaning blade has been used as a cleaning unit for removing a remaining toner or the like on a surface of an image holding member such as a photoreceptor.

SUMMARY

According to an aspect of the invention, there is provided a cleaning blade wherein at least a portion which comes in contact with a member to be cleaned is configured of a member having dynamic ultra micro hardness of from 0.25 to 0.65 and an index K acquired in the following Equation (1) of equal to or more than 15.

$$\text{index } K = [23^\circ \text{ C. breaking elongation } (\%)] \times [10^\circ \text{ C. impact resilience } (\%)] \times (-1) \times [\tan\delta \text{ peak temperature } (^\circ \text{ C.})] / [\text{Young's modulus (MPa)}] / 1000. \quad \text{Equation (1)}$$

BRIEF DESCRIPTION OF THE DRAWINGS

Exemplary embodiments of the present invention will be described in detail based on the following figures, wherein.

DETAILED DESCRIPTION

Figure 1:
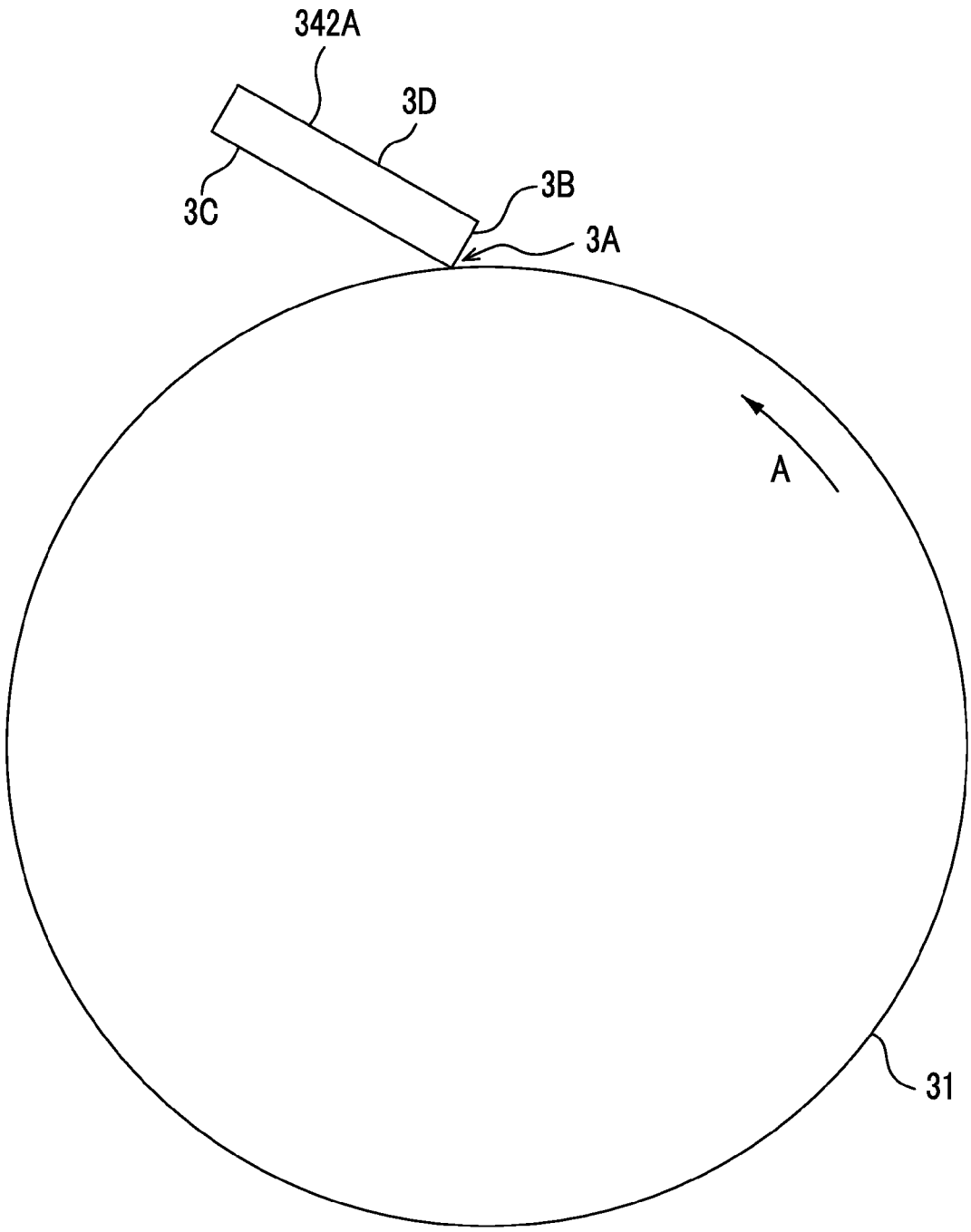
FIG. 1 is a schematic view showing an example of a cleaning blade according to an exemplary embodiment.

Hereinafter, exemplary embodiments of a cleaning blade, a cleaning device, a process cartridge, and an image forming apparatus of exemplary embodiments of the invention will be described in detail.

Cleaning Blade

In the cleaning blade according to the exemplary embodiment, at least a portion which comes in contact with a member to be cleaned is configured of a member which satisfies the following (a) and (b).

(a) Dynamic ultra micro hardness is from 0.25 to 0.65.

(b) An index K acquired in the following Equation (1) is equal to or more than 15.

$$\text{Index } K = [23^\circ \text{ C. breaking elongation } (\%)] \times [10^\circ \text{ C. impact resilience } (\%)] \times (-1) \times [\tan\delta \text{ peak temperature } (^\circ \text{ C.})] / [\text{Young's modulus (MPa)}] / 1000 \quad \text{Equation (1)}$$

In addition, in the specification, a member which configures a region including a portion of the cleaning blade which comes in contact with the member to be cleaned is called a "contacting member". The cleaning blade according to the exemplary embodiment may be formed of only the contacting member.

In addition, in a case where the contacting member and a region other than the contacting member are configured with different materials in the cleaning blade, the member which configures the region other than the contacting member is called a "non-contacting member". The non-contacting member may be configured of single type of material or may be configured from a member with two or more different materials.

From a viewpoint of suppressing torque of the member to be cleaned to the surface of which the cleaning blade is pressed on, a pressing force of the cleaning blade is required to be further reduced, and according to this, a cleaning blade which may maintain an excellent cleaning property although the pressing force is reduced compared to the related art has been required.

For this point, an excellent cleaning property is exhibited by improving the hardness of a portion of the cleaning blade which comes in contact with a member to be cleaned, and in particular, the cleaning property is improved by setting dynamic ultra micro hardness of the portion of the cleaning blade which comes in contact with the member to be cleaned to be equal to or more than 0.25.

However, if the hardness of the cleaning blade is improved, there is a concern that cracks easily occur in a contacting part of a member to be cleaned. Further, pass through occurs on an attachment attached on the surface of the member to be cleaned in the portion where the cracks occur, in some cases.

For this point, in the cleaning blade according to the exemplary embodiment, by controlling the index K to be equal to or less than a certain number, a cleaning property is maintained by adjustment of the hardness and generation of cracks is suppressed.

Herein, a process with which the Equation (1) showing the index K is developed will be described.

In the cleaning blade, since it is unclear that with which physical property the generation of the cracks has a close relationship, cleaning blades with various physical properties are prepared and correlations between the physical property and a degree of generation of cracks are investigated. For example, with regard to 23° C. breaking elongation among various physical properties, a result which shows a correlation with the generation of cracks is obtained under certain conditions, however, if the conditions are changed, the correlation is not satisfied such as that a portion where the generation of cracks is remarkably degraded is generated regardless of a size of the breaking elongation, such that it is difficult to logically describe the relationship with the cracks with only the breaking elongation. In addition, even with regard to 10° C. impact resilience, a tan δ peak temperature, and a Young's modulus, in the same manner as the breaking elongation, a case where a correlation is acquired and a case where a correlation is not satisfied are found depending on different conditions, such that it is difficult to logically describe the relationship with the cracks with only a single physical property.

Further, the correlation with the degree of generation of cracks is investigated by selecting two physical properties from the various physical properties. For example, values of two physical properties of 23° C. breaking elongation and 10° C. impact resilience are adjusted and the correlation between the sum of the two values and the degree of generation of cracks is investigated, however, it is difficult to find a logical relationship. In addition, two other various physical properties are selected; however it is difficult to logically describe the relationship with the cracks. Further, in a case where three various physical properties are selected and a correlation with the degree of generation of cracks is investigated, it is also difficult to find a logical relationship.

Meanwhile, from the various physical properties obtained from the cleaning blade, it is found that an index K which is derived from a relation equation shown in Equation (1) which regards four physical property values of 23° C. breaking elongation, 10° C. impact resilience, a tan δ peak temperature, and a Young's modulus, shows a close relationship with respect to generation of cracks.

That is, the cleaning blade according to the exemplary embodiment is obtained by finding out that which properties are intertwined with each other to influence an effect with regard to the degree of generation of cracks, that is difficult to be described since there is a case where the correlation between the cracks and single physical property may be described under fixed conditions, while the correlation is not satisfied under other conditions.

By controlling the index K which is derived from a relation equation with four physical property values of 23° C. breaking elongation, 10° C. impact resilience, a tan δ peak temperature, and Young's modulus, to be equal to or less than the numerical values, although there is a case where the dynamic ultra micro hardness is increased to the range thereof described above, the generation of cracks on the portion of the cleaning blade that comes in contact with the member to be cleaned is efficiently suppressed.

In addition, it is more preferable that a numerical value of the index K is equal to or more than 25.

Herein, each of four physical properties configuring the Equation (1) will be described.

23° C. Breaking Elongation

Measurement of 23° C. breaking elongation (%) is performed in an environment of 23° C. based on JIS K 6251 (2010). In addition, in a case where the size of the contacting member which configures the region including the portion of the cleaning blade which comes in contact with the member to be cleaned is equal to or larger than a dimension of a dumbbell-shaped No. 3 type test piece, the measurement is performed by cutting out a piece of which the dimension is equal to the dimension of the dumbbell-shaped No. 3 type test piece from the member. Meanwhile, in a case where the size of the contacting member is smaller than a dimension of a dumbbell-shaped No. 3 type test piece, the dumbbell-shaped No. 3 type test piece is formed with the same material as the member, and the measurement is performed for the test piece.

A physical property value of 23° C. breaking elongation of the contacting member is controlled by the following unit, for example.

For example, if the contacting member is polyurethane, for example, the 23° C. breaking elongation tends to become large due to high molecular weight of polyol, and also tends to become large due to reduction of a cross-linking agent.

However, the adjustment of the 23° C. breaking elongation is not limited to the method described above.

From a viewpoint of efficiently suppressing the cracks, a numerical value of the 23° C. breaking elongation of the contacting member is preferably equal to or more than 250%, more preferably equal to or more than 300%, and further preferably equal to or more than 350%. In addition, from a viewpoint of edge abrasion, an upper limit value thereof is preferably equal to or less than 500%, more preferably equal to or less than 450%, and further preferably equal to or less than 400%.

10° C. Impact Resilience

Measurement of the 10° C. impact resilience (%) is performed under an environment at 10° C. based on JIS K 6255 (1996). In addition, in a case where the size of the contacting member of the cleaning blade is equal to or larger than a dimension of a standard test piece of JIS K 6255, the measurement is performed by cutting out apiece of which the dimension is equal to the dimension of the test piece from the member. Meanwhile, in a case where the size of the contacting member is smaller than the dimension of the test piece, the test piece is formed with the same material as the member, and the measurement is performed for the test piece.

A physical property value of the 10° C. impact resilience of the contacting member is controlled by the following unit, for example.

For example, the 10° C. impact resilience tends to become larger as crosslink density is improved due to trifunctionalization of crosslinking agent or increase in amount thereof. In addition, if the contacting member is polyurethane, for example, the 10° C. impact resilience tends to become larger by reducing a glass transition temperature (Tg) due to low molecular weight of polyol or a method of introducing hydrophobic polyol.

However, the adjustment of the 10° C. impact resilience is not limited to the method described above.

From a viewpoint of suppressing generation of local plastic deformation, a numerical value of the 10° C. impact resilience of the contacting member is preferably equal to or more than 10%, more preferably equal to or more than 15%, and further preferably equal to or more than 20%. In addition, from a viewpoint of suppressing blade noise, an upper limit value thereof is preferably equal to or less than 80%, more preferably equal to or less than 70%, and further preferably equal to or less than 60%.

tan δ Peak Temperature

A tan δ (loss tangent) peak temperature of the contacting member of the cleaning member shows a glass transition temperature (Tg).

Herein, a tan δ value is derived from a storage elastic modulus and a loss elastic modulus which will be described later. In a case where a sine wave strain is applied to a linear elastic member in a stationary vibration manner, stress is shown in Equation (2). In addition, |E*| is called a complex modulus. In addition, an elastic member component is shown in Equation (3) and a viscous member component is shown in Equation (4) by rheology. Herein, E' is referred to as a storage elastic modulus, and E" is referred to as a loss elastic modulus. δ shows a phase difference angle between stress and strain and is referred to as a "mechanical loss angle". tan δ value is shown by E"/E' as shown in Equation (5), and is referred to as a "loss sine", as the value thereof becomes larger, the linear elastic member thereof has rubber elasticity.

$$\sigma=|E^*|\gamma\cos(\omega t) \quad \text{Equation (2)}$$

$$E'=|E^*|\cos\delta \quad \text{Equation (3)}$$

$$E''=|E^*|\sin\delta \quad \text{Equation (4)}$$

$$\tan\delta=E''/E' \quad \text{Equation (5)}$$

The tan δ value is measured with conditions of static strain 5% and 10 Hz sine wave tensile vibration in a temperature range from −60° C. to 100° C. with Rheospectoler-DVE-V4 (manufactured by Rheology co., Ltd.).

The physical property value of the tan δ peak temperature of the contacting member is controlled by the following unit, for example.

For example, if the contacting member is polyurethane, for example, the tan δ peak temperature tends to become higher due to low molecular weight of polyol, and also tends to become higher due to increase of the amount of cross-linking agent.

However, the adjustment of the tan δ peak temperature is not limited to the method described above.

The numeral value of the tan δ peak temperature of the contacting member is preferably equal to or lower than the temperature of the environment where the cleaning blade is used, for example, preferably equal to or lower than 10° C., more preferably equal to or lower than 0° C., and further preferably equal to or lower than −10° C., for example.

Young's Modulus

The Young's modulus is calculated with the following equation by measuring a force ΔS applied to a unit cross-sectional area and elongation Δa of a unit length.

$$E=\Delta S/\Delta a \quad \text{Equation:}$$

Herein, ΔS is calculated with a load F and a film thickness t of a sample and sample width w as shown below, and Δa is calculated with a reference length L of a sample, and sample elongation ΔL at the time of applying a load as shown below.

$$\Delta S=F/(w\times t) \quad \text{Equation:}$$

$$\Delta a=\Delta L/L \quad \text{Equation:}$$

A tensile tester (tensile tester MODEL-1605N manufactured by Aikoh Engineering Co., Ltd.) is used for the measurement of the Young's modulus. In addition, in a case where the size of the contacting member of the cleaning blade is the size equal to or more than the dimension of the sample (test piece) for the measurement described above, the measurement described above is performed by cutting out apiece of which the dimension is equal to the dimension of the sample from the member. Meanwhile, in a case where the size of the contacting member is less than the dimension of the sample, a sample is formed with the same material as the member, and the measurement is performed for the sample.

The physical property value of the Young's modulus of the contacting member is controlled by the following unit, for example.

For example, the Young's modulus tends to become large due to increase of chemical crosslink (increase of crosslink points), and also tends to become large due to increase of the amount of hard segments if the contacting member is polyurethane, for example.

However, the adjustment of the Young's modulus is not limited to the method described above.

From a viewpoint of suppressing that an excellent cleaning property is not obtained due to insufficient hardness of the contacting member, the numerical value of the Young's modulus of the contacting member is preferably equal to or more than 5 MPa, more preferably equal to or more than 10 MPa, and further preferably equal to or more than 15 MPa, for example. In addition, from a viewpoint of suppressing that an excellent cleaning property is not obtained because the cleaning blade does not follow the driving member to be cleaned due to the contacting member being too hardened, the upper limit value thereof is preferably equal to or less than 35 MPa, more preferably equal to or less than 30 MPa, and further preferably equal to or less than 25 MPa.

Dynamic Ultra Micro Hardness

In addition, the dynamic ultra micro hardness of the contacting member of the cleaning blade will be described.

The dynamic ultra micro hardness is hardness calculated with a test load P (mN) and a pressing depth D (μm) when indenting an indenter into a specimen at a constant pressing speed (mN/s) as shown in the following equation.

$$DH=\alpha\times P/D^2 \quad \text{Equation:}$$

In the equation, α shows a constant due to an indenter shape.

In addition, the measurement of the dynamic ultra micro hardness is performed with Dynamic Ultra Micro Hardness tester DUH-W201S (manufactured by Shimadzu Corporation). The dynamic ultra micro hardness is acquired by measuring the pressing depth D when indenting a diamond triangular pyramid indenter (interridge angle: 115°, α: 3.8584) at the pressing speed of 0.047399 mN/s, with a test load of 4.0 mN, and in an environment at 23° C. by soft material measurement.

In addition, the portion of the cleaning blade which comes in contact with the member to be cleaned is normally a corner portion. Accordingly, from a viewpoint of performing measurement in a location to indent the triangular pyramid indenter, in a state where the corner portion configures one side and the corner portion comes in contact with the driving member to be cleaned, the actual measurement portion is set to a location which is deviated by 0.5 mm from the corner portion with respect to a surface (ventral surface) facing the downstream side of the driving direction. In addition, the measurement is performed for three arbitrary portions of the measurement portion, and the average value thereof is set to the dynamic ultra micro hardness.

The physical property of the dynamic ultra micro hardness of the contacting member is controlled by the following unit, for example.

For example, if the material of the contacting member of the cleaning blade is polyurethane, the dynamic ultra micro hardness tends to become high by improving crystallinity of the polyurethane. In addition, the dynamic ultra micro hardness tends to become high due to increase of chemical crosslink (increase of crosslink points), and also tends to become high due to increase of the amount of hard segments.

However, the adjustment of the dynamic ultra micro hardness is not limited to the method described above.

The numerical value of the dynamic ultra micro hardness of the contacting member is from 0.25 to 0.65. If the dynamic ultra micro hardness is less than the lower limit value, an excellent cleaning property is not obtained due to insufficient hardness of the contacting member. Meanwhile, if the dynamic ultra micro hardness exceeds the upper limit value, since the cleaning blade does not follow the driving member to be cleaned because the contacting member is too hardened, an excellent cleaning property is not obtained.

In addition, the dynamic ultra micro hardness is more preferably from 0.28 to 0.63 and further preferably from 0.3 to 0.6.

Next, a configuration of the cleaning blade according to the exemplary embodiment will be described.

It is necessary for the cleaning blade of the exemplary embodiment to include a member which satisfies the following (a) and (b) at least in the portion (contacting member) which comes in contact with the member to be cleaned.

(a) The dynamic ultra micro hardness is from 0.25 to 0.65.

(b) The index K acquired from the following equation (1) is equal to or more than 15.

$$\text{Index } K = [23^\circ\text{ C. breaking elongation (\%)}] \times [10^\circ\text{ C. impact resilience (\%)}] \times (-1) \times [\tan\delta \text{ peak temperature } (^\circ\text{ C.})] / [\text{Young's modulus (MPa)}] / 1000 \quad \text{Equation (1)}$$

That is, the cleaning blade according to the exemplary embodiment may be only formed of the contacting member. In addition, the cleaning blade may have a two-layer configuration in that a first layer which is formed of the contacting member and comes in contact with a surface of a member to be cleaned and a second layer on the rear surface of the first layer as a rear surface layer are provided, or may have a three or more layered configuration. Also, the cleaning blade may have a configuration in that only the corner portion of the portion which comes in contact with the member to be cleaned is formed of the contacting member and the periphery thereof is formed of another material.

In addition, in a case where the cleaning blade is configured of the contacting member and a region other than the contacting member with different materials, respectively, the member configuring the region other than the contacting member is called a "non-contacting member".

Herein, an example of the cleaning blade according to the exemplary embodiment will be described with reference to the drawings.

FIG. 1 is a schematic view showing a cleaning blade according to a first exemplary embodiment, and a view showing a state where the cleaning blade comes in contact with a surface of an electrophotographic photoreceptor which is an example of the member to be cleaned. In addition, FIG. 2 is a view showing a state where a cleaning blade according to a second exemplary embodiment comes in contact with a surface of an electrophotographic photoreceptor, and FIG. 3 is a view showing a state where a cleaning blade according to a third exemplary embodiment comes in contact with a surface of an electrophotographic photoreceptor.

In addition, in the drawing shown below, for each portion of the cleaning blade, an corner portion which comes in contact with a photoreceptor 31 driving in an arrow A direction to clean the surface of the photoreceptor 31 is set as a contacting corner portion 3A, a surface one side of which is configured with the contacting corner portion 3A which faces the upstream side of the driving direction (arrow A direction) is set as a tip surface 3B, a surface one side of which is configured with the contacting corner portion 3A which faces the downstream side of the driving direction (arrow A direction) is set as a ventral surface 3C, and a surface which shares one side with the tip surface 3B and opposes the ventral surface 3C is set as a rear surface 3D. In addition, a direction parallel with the contacting corner portion 3A (that is, direction from the front to the inside in FIG. 1) is set as a depth direction, a direction from the contacting corner portion 3A to the side where the tip surface 3B is formed is set as a thickness direction, and a direction from the contacting corner portion 3A to the side where the ventral surface 3C is formed is set as a width direction.

Entirety of a cleaning blade 342A according to the first exemplary embodiment is configured of single material including a portion which comes in contact with the photoreceptor 31, that is, the contacting corner portion 3A, and that is to say, the cleaning blade 342A is formed of only the contacting member.

Figure 2:
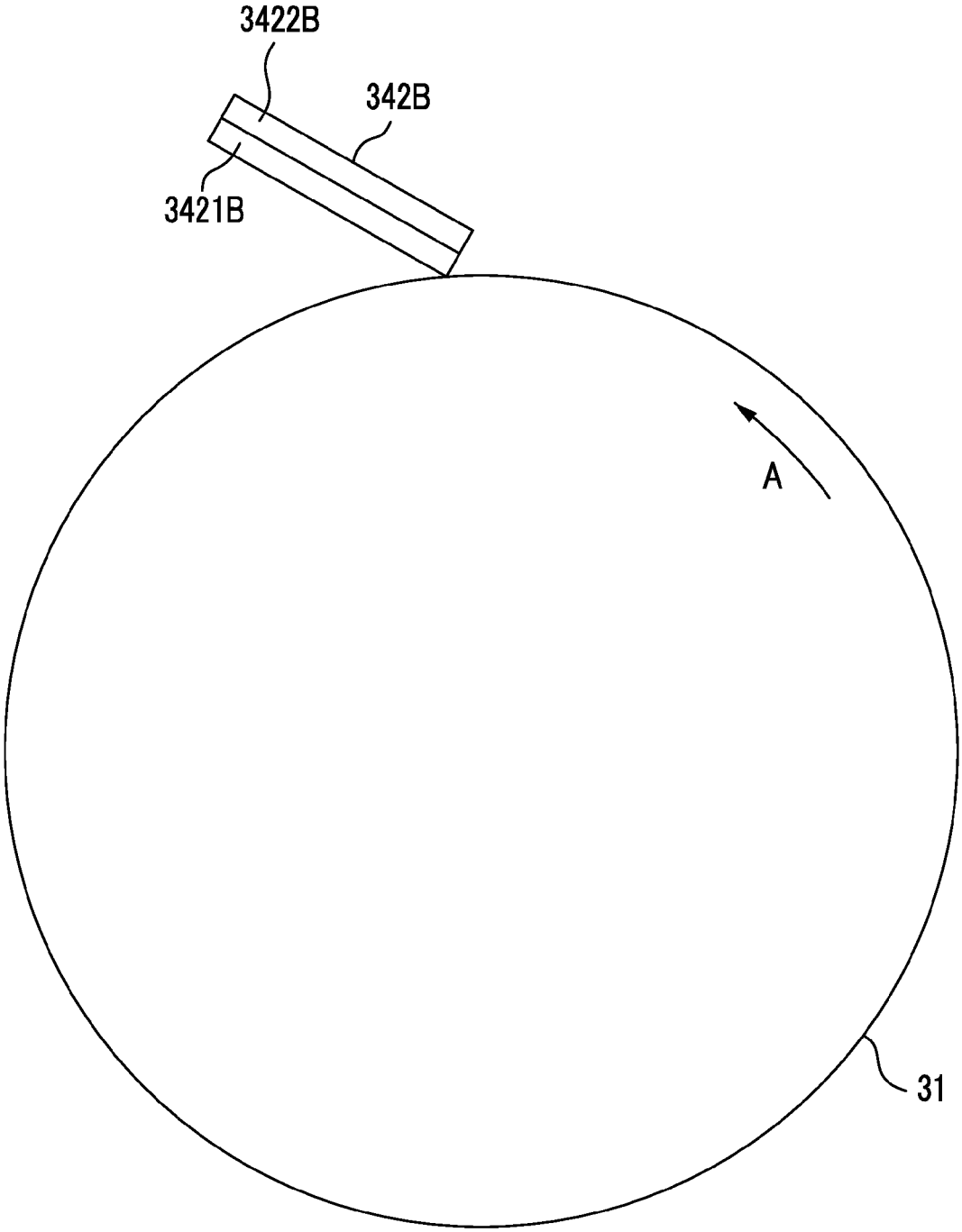
FIG. 2 is a schematic view showing another example of a cleaning blade according to an exemplary embodiment.
Figure 3:
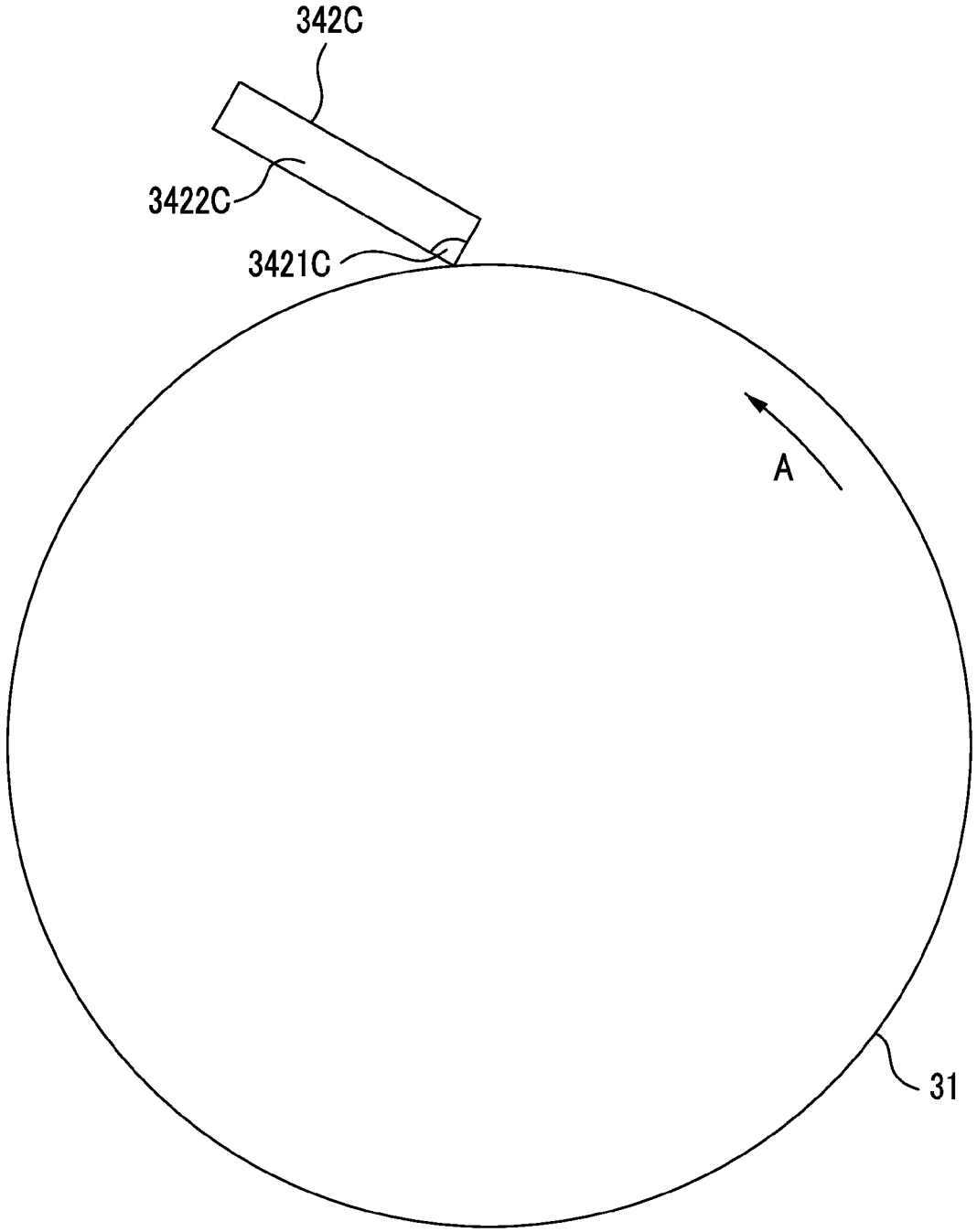
FIG. 3 is a schematic view showing another example of a cleaning blade according to an exemplary embodiment.

In addition, as the second exemplary embodiment shown in FIG. 2, the cleaning blade 342B according to the exemplary embodiment may have a two-layer configuration in that a first layer 3421B which includes the portion which comes in contact with the photoreceptor 31, that is, the contacting corner portion 3A, is formed over the entire surface of the ventral surface 3C side and is formed of the contacting member, and a second layer 3422B as a rear surface layer which is formed on the rear surface 3D side with respect to the first layer and is formed of a material different from the contacting member are provided.

Further, as the third exemplary embodiment shown in FIG. 3, the cleaning blade 342C according to the exemplary embodiment may have a configuration in that a contacting member 3421C formed of a contacting member which includes the portion which comes in contact with the photoreceptor 31, that is, the contacting corner portion 3A, has a shape obtained by elongating a quarter-cut cylinder in the depth direction, and includes a right angular portion of the shape forming the contacting angular portion 3A, and a rear surface member 3422C formed of a material different from the contacting member which covers the rear surface 3D side of the contacting member 3421C in the thickness direction and the side opposite to the tip surface 3B in the width direction, that is, configures the portion other than the contacting member 3421C.

Next, in the cleaning blade of the exemplary embodiment, composition of the contacting member configuring at least the portion which comes in contact with the member to be cleaned will be described.

Contacting Member

The contacting member of the cleaning blade according to the exemplary embodiment is not particularly limited as long as the contacting member satisfies the (a) and (b) described above. For example, polyurethane rubber, silicon rubber, fluoro-rubber, chloroprene rubber, butadiene rubber, or the like is used for the contacting member. In addition, from a viewpoint of satisfying conditions of the dynamic ultra micro hardness of the (a) described above, polyurethane rubber is preferable and particularly high crystallinity polyurethane rubber is more preferable.

As a method of improving crystallinity of the polyurethane, a method of further growing hard segment aggregates of the polyurethane is used, for example. In detail, an environment in which the hard segment aggregates are easy to further grow, is prepared by adjusting so that physical crosslink (crosslink due to hydrogen bond between hard segments) progresses more efficiently than chemical crosslink (crosslink due to a cross-linking agent) when forming a crosslink structure of polyurethane. In addition, as a polymerization temperature is set to be lower at the time of polymerizing polyurethane, the aging time becomes longer, and as a result, the physical crosslink tends to progress further.

Endothermic Peak Top Temperature

An endothermic peak top temperature (melting temperature) is used for an index of crystallinity. In the cleaning blade according to the exemplary embodiment, an endothermic peak top temperature (melting temperature) obtained by differential scanning calorimetry (DSC) is preferably equal to or higher than 180° C., more preferably equal to or higher than 185° C., and further preferably equal to or higher than 190° C. In addition, the upper limit value thereof is preferably equal to or lower than 220° C., more preferably equal to or lower than 215° C., and further preferably equal to or lower than 210° C.

In addition, the endothermic peak top temperature (melting temperature) is measured based on ASTM D3418-99 with differential scanning calorimetry (DSC). PerkinElmer's Diamond-DSC is used for the calorimetry, a melting temperature of indium and zinc is used for temperature correction of a device detection unit, and heat of fusion of indium is used for correction of calorie. An aluminum pan is used for a calorimetry sample, and an empty pan is set for comparison and the calorimetry is performed.

Particle Size and Particle Size Distribution of Hard Segment Aggregate

In addition, in the exemplary embodiment, it is preferable that the polyurethane rubber includes hard segments and soft segments, and an average particle size of aggregates of the hard segments is from 5 μm to 20 μm.

By setting the average particle size of the aggregates of the hard segments to be equal to or more than 5 μm, it is favorable to increase a crystalline area in the blade surface and to improve a sliding property. Meanwhile, by setting the average particle size of the aggregates of the hard segments to be equal to or less than 20 μm, it is advantageous to maintain a low-friction property and not to lose toughness (crack resistance).

The average particle size is more preferably from 5 μm to 15 μm, and further preferably from 5 μm to 10 μm.

In addition, it is preferable that the particle size distribution (standard deviation σ) of the aggregates of the hard segments is equal to or more than 2.

The particle size distribution (standard deviation σ) of the aggregates of the hard segments being equal to or more than 2 shows that various particle sizes are mixed, and an effect of high hardness due to the increase of the contacting area with the soft segments, is obtained with small aggregates, and meanwhile, an effect of the improvement of the sliding property is obtained with large aggregates.

The particle size distribution is more preferably from 2 to 5, and further preferably from 2 to 3.

In addition, the average particle size and the particle size distribution of the hard segment aggregates are measured with the following method. An image is captured with a magnification of 20× by using a polarization microscope (BX51-P manufactured by Olympus), the image is binarized by being subjected to a image processing, the particle size thereof is measured with 20 cleaning blades by measuring five points for one cleaning blade (measuring five aggregates for one point), and the average particle size from 500 particle sizes is calculated.

In addition, with the image binarization, threshold values of hue, chroma, and illuminance are adjusted so as to display black for crystal portion and white for non-crystal portion by using image processing software of OLYMPUS Stream essentials (manufactured by Olympus).

In addition, the particle size distribution (standard deviation σ) is calculated from the measured 500 particle sizes with the following equation.

$$\text{Standard deviation } \sigma=\sqrt{\{(X1-M)^2+(X2-M)^2+\ldots+(X500-M)^2\}/500}$$

Xn: Measured particle size n (n=from 1 to 500)

M: Average value of the measured particle size

The particle size and the particle size distribution of the hard segment aggregates are controlled in the range described above. A unit therefor is not particularly limited, and for example, methods of reaction control with a catalyst, three-dimensional network control with a cross-linking agent, crystal growth control with aging conditions, and the like are used.

The polyurethane rubber is typically synthesized by polymerizing polyisocyanate and polyol. In addition, other than polyol, a resin including a functional group which may react with an isocyanate group may be used. In addition, it is preferable that the polyurethane rubber includes hard segments and soft segments.

Herein, the "hard segments" and the "soft segments" mean segments which are configured of a material, in which a material configuring the former is relatively harder than a material configuring the latter, and a material configuring the latter is relatively softer than a material configuring the former, in the polyurethane rubber materials.

It is not particularly limited, however, as a combination of the material (hard segment material) configuring the hard segments and the material (soft segment material) configuring the soft segments, well-known resin materials may be selected so as to have a combination in which one is relatively harder than the other, and the other one is relatively softer than the first. In this exemplary embodiment, the following combination is suitable.

Soft Segment Material

First, polyol as the soft segment material, polyester polyol obtained by a dehydration condensation of diol and dibasic acid, polycarbonate polyol obtained with a reaction of diol and alkyl carbonate, polycaprolactone polyol, polyether polyol, or the like is used. In addition, as a commercialized product of the polyol used as the soft segment material, PLACCEL 205 or PLACCEL 240 manufactured by Daicel Corporation is used.

Hard Segment Material

In addition, as the hard segment material, it is preferable to use a resin including a functional group which may react with respect to an isocyanate group. Further, a flexible resin is preferable, and a resin with aliphatic system including a straight-chain structure is more preferable from a viewpoint of flexibility. As a detailed example, it is preferable to use an acrylic resin including two or more hydroxyl groups, a polybutadiene resin including two or more hydroxyl groups, an epoxy resin including two or more epoxy groups, or the like.

As a commercialized product of the acrylic resin including two or more hydroxyl groups, for example, ACTFLOW (Grade: UMB-2005B, UMB-2005P, UMB-2005, UME-2005 or the like) manufactured by Soken Chemical & Engineering Co., Ltd is used.

As a commercialized product of the polybutadiene resin including two or more hydroxyl groups, for example, R-45HT or the like manufactured by Idemitsu Kosan Co., Ltd. is used.

As the epoxy resin including two or more epoxy groups, a resin having a hard and fragile property as a general epoxy resin of the related art is not preferable, but a resin having a softer and stronger property than the epoxy resin of the related art is preferable. As the epoxy resin, for example, in a property of a molecular structure, a resin including, in a main chain structure thereof, a structure (flexible skeleton) which may increase the mobility of the main chain is suitable, and as the flexible skeleton, an alkylene skeleton, cycloalkane skeleton, a polyoxyalkylene skeleton or the like is used, and particularly a polyoxyalkylene skeleton is suitable.

In addition, in a physical property, an epoxy resin in which viscosity is low compared with molecular weight is suitable compared with the epoxy resin of the related art. In detail, weight-average molecular weight is in a range of 900±100, viscosity in 25° C. is preferably in a range of 15000±5000 mPa·s and more preferably in a range of 15000±3000 mPa·s. As a commercialized product of the epoxy resin including the properties described above, EPLICON EXA-4850-150 or the like manufactured by DIC Corporation is used.

In a case of using the hard segment material and the soft segment material, a weight ratio (hereinafter, referred to as "hard segment material ratio") of the material configuring the hard segment with respect to the total amount of the hard segment material and the soft segment material is preferably in a range from 10% by weight to 30% by weight, more preferably in a range from 13% by weight to 23% by weight, and even more preferably in a range from 15% by weight to 20% by weight.

Since the hard segment material ratio is equal to or more than 10% by weight, the abrasion resistance property is obtained and an excellent cleaning property is maintained over a long period. Meanwhile, since the hard segment material ratio is equal to or less than 30% by weight, the flexibility and expendability is obtained while preventing becoming too hard, the generation of the cracks is suppressed, and an excellent cleaning property is maintained over a long period.

Polyisocyanate

As polyisocyanate used for the synthesis of the polyurethane rubber, for example, 4,4'-diphenyl methane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI) are used.

In addition, in a viewpoint of easy formation of the hard segment aggregate with the desired size (particle size), as polyisocyanate, 4,4'-diphenyl methane diisocyanate (MDI), 1,5-naphthalene diisocyanate (NDI), and hexamethylene diisocyanate (HDI) are more preferable.

A blending quantity of polyisocyanate with respect to resins with 100 parts by weight including a functional group which may react with respect to the isocyanate group is preferably from 20 parts by weight to 40 parts by weight, more preferably from 20 parts by weight to 35 parts by weight, and further preferably from 20 parts by weight to 30 parts by weight.

Since the blending quantity is equal to or more than 20 parts by weight, a large bonding amount of urethane is secured to obtain the hard segment growth, and a desired hardness is obtained. Meanwhile, since the blending quantity is equal to or less than 40 parts by weight, the hard segment does not become too large, the expandability is obtained, and the generation of the crack on the cleaning blade is suppressed.

Cross-linking Agent

As a cross-linking agent, diol (bifunction), triol (trifunction), tetraol (tetrafunction), or the like is used, and these may be used together. In addition, as a cross-linking agent, an amine based compound may be used. Further, a cross-linking agent with trifunction or more is preferably used for cross-linking. As the trifunctional cross-linking agent, for example, trimethylolpropane, glycerin, tri-isopropanolamine and the like are used.

A blending quantity of the cross-linking agent with respect to resins with 100 parts by weight including a functional group which may react with respect to the isocyanate group is preferably equal to or less than 2 parts by weight. Since the blending quantity is equal to or less than 2 parts by weight, molecular motion is not restrained due to chemical crosslink, hard segment derived from urethane bonding due to aging is largely grown, and the desired hardness is easily obtained.

Method of Manufacturing Polyurethane Rubber

For manufacture of the polyurethane rubber member configuring the contacting member of the exemplary embodiment, a general method of manufacturing the polyurethane such as a prepolymer method or a one-shot method is used. Since polyurethane with excellent strength and abrasion resistance property is obtained, the prepolymer method is suitable for the exemplary embodiment, however the method of manufacturing is not limited.

In addition, as a unit that suppresses the endothermic peak top temperature (melting temperature) of the contacting member within the range described above, a method of improving crystalline property of the polyurethane member and suppressing the endothermic peak top temperature within a proper range is used, and for example, a method of further growing the hard segment aggregate of the polyurethane is used. In detail, a method of adjusting so that physical crosslink (crosslink with hydrogen bond between hard segments) proceeds efficiently compared to the chemical crosslink (crosslink with the cross-linking agent) in a case of the formation of the cross-linked structure of the polyurethane is used, and in a case of polymerization of the polyurethane, as a polymerization temperature is set to be lower, the aging time becomes longer, and as a result, the physical crosslink tends to proceed more.

Such polyurethane rubber member is molded by blending the isocyanate compound and the cross-linking agent or the like to the polyol described above under molding conditions which may suppress unevenness of molecular arrangement.

In detail, in a case of adjusting a polyurethane composition, the polyurethane composition is adjusted by setting a temperature of polyol or prepolymer low or setting a temperature of curing and molding low so the crosslink proceeds slowly. Since the urethane bonding portion is aggregated and a crystalline member of the hard segment is obtained by setting the temperatures (temperature of polyol or prepolymer and temperature of curing and molding) low to lower a reactive property, the temperatures are adjusted so that the particle size of the hard segment aggregate becomes the desired crystal size.

Accordingly, a state in which the molecules included in the polyurethane composition are arranged is set, and in a case of measuring the DSC, the polyurethane rubber member including the crystalline member in which the endothermic peak top temperature of crystal melting energy is in the range described above is molded.

In addition, the amounts of the polyol, the polyisocyanate, and the cross-linking agents, ratio of cross-linking agents, and the like are adjusted within a desired range.

In addition, the molding of the cleaning blade is performed by forming the composition for cleaning blade formation prepared by the method described above in a sheet shape and performing a cut process and the like, using centrifugal molding or extrusion molding for example.

Herein, as an example, a method of manufacturing the contacting member will be described in detail.

First, the soft segment material (for example, polycaprolactone polyol) and the hard segment material (for example, acrylic resin including two or more hydroxyl groups) are mixed (for example, a weight ratio of 8:2).

Next, the isocyanate compound (for example, 4,4'-diphenyl methane diisocyanate) is added with respect to the mixture of the soft segment material and the hard segment material, and reacts under a nitrogen atmosphere for example. At that time, the temperature is preferably from 60° C. to 150° C. and more preferably from 80° C. to 130° C. In addition, the reaction time is preferably from 0.1 hour to 3 hours, and more preferably from 1 hour to 2 hours.

Next, the isocyanate compound is further added to the mixture, and the mixture is reacted under a nitrogen atmosphere for example, to obtain a prepolymer. At that time, the temperature is preferably from 40° C. to 100° C. and more preferably from 60° C. to 90° C. In addition, the reaction time is preferably from 30 minutes to 6 hours, and more preferably from 1 hour to 4 hours.

Next, the temperature of the prepolymer is increased and the prepolymer is subjected to defoaming under the reduced pressure. At that time, the temperature is preferably from 60° C. to 120° C. and more preferably from 80° C. to 100° C. In addition, the reaction time is preferably from 10 minutes to 2 hours, and more preferably from 30 minutes to 1 hour.

After that, a cross-linking agent (for example, 1,4-butanediol or trimethylolpropane) is added and mixed with respect to the prepolymer, and a composition for the cleaning blade formation is prepared.

Next, the composition for the cleaning blade formation is poured into a mold of a centrifugal molding machine, and subjected to the curing reaction. At that time, the mold temperature is preferably from 80° C. to 160° C., and more preferably from 100° C. to 140° C. In addition, the reaction time is preferably from 20 minutes to 3 hours, and more preferably from 30 minutes to 2 hours.

Further, the mold is subjected to cross-linking reaction, and accordingly, the contacting member is formed. The temperature of aging heating in a case of cross-linking reaction is preferably from 70° C. to 130° C., and more preferably from 80° C. to 130° C., and further more preferably from 100° C. to 120° C. In addition, the reaction time is preferably from 1 hour to 48 hours, and more preferably from 10 hours to 24 hours.

Physical Property

In the contacting member, a ratio of the physical crosslink (cross-link with hydrogen bond between hard segments) to the chemical crosslink (crosslink with cross-linking agent) "1" in the polyurethane rubber is preferably 1:0.8 to 1:2.0, and more preferably 1:1 to 1:1.8.

Since the ratio of the physical crosslink to the chemical crosslink is equal to or more than the lower limit, the hard segment aggregate further grows and an effect of the low friction property derived from the crystal is obtained. Meanwhile, since the ratio of the physical crosslink to the chemical crosslink is equal to or less than the upper limit, an effect of maintaining the toughness is obtained.

In addition, the ratio of the chemical crosslink and the physical crosslink is calculated using the following Mooney-Rivlin equation.

$$\sigma=2C_1(\lambda-1/\lambda^2)+2C_2(1-/\lambda^3)$$

σ: stress, λ: strain, $C_1$: chemical crosslink concentration, $C_2$: physical crosslink concentration In addition, σ and λ at the time of extension of 10% are used with a stress-strain line by a tension test.

In the specified member, a ratio of the hard segment to the soft segment "1" in the polyurethane rubber is preferably 1:0.15 to 1:0.3, and more preferably 1:0.2 to 1:0.25.

Since the ratio of the hard segment to the soft segment is equal to or more than the lower limit, an amount of hard segment aggregates increases and thus an effect of the low-friction property is obtained. Meanwhile, Since the ratio of the hard segment to the soft segment is equal to or less than the upper limit, an effect of maintaining the toughness is obtained.

In addition, with the ratio of the soft segment and the hard segment, a composition ratio is calculated from a spectrum area of isocyanate as the hard segment component, a chain extender, and polyol as the soft segment component, using $^1$H-NMR.

The weight-average molecular weight of the polyurethane rubber member of the exemplary embodiment is preferably in a range of 1000 to 4000, and more preferably in a range of 1500 to 3500.

Next, composition of the non-contacting member of a case where the contacting member and the region other than the contacting member (non-contacting member) of the cleaning blade of the exemplary embodiment are configured of materials different from each other, as the second exemplary embodiment shown in FIG. 2 or the third exemplary embodiment shown in FIG. 3 will be described.

Non-Contacting Member

The non-contacting member of the cleaning blade according to the exemplary embodiment is not particularly limited, and any known materials may be used.

Impact Resilience

It is preferable that the non-contacting member is configured of, among such known materials, a material having impact resilience at 50° C. of equal to or less than 70%.

When cleaning by bringing the cleaning blade in contact with the member to be cleaned such as an electrophotographic photoreceptor, an adhesive force is generated between the member to be cleaned and the cleaning blade depending on a usage environment, frictional resistance on a contacting surface of tips of the member to be cleaned and the cleaning blade becomes large, amplitude of the cleaning blade becomes larger with the driving of the member to be cleaned, and thus, abnormal noise which is so-called "blade noise" may occur.

However, by providing the non-contacting member with the impact resilience in the range described above, the generation of the abnormal noise is efficiently suppressed.

The measurement of the impact resilience (%) at 50° C. is performed under an environment at 50° C. based on JIS K 6255 (1996). In addition, in a case where the size of the non-contacting member of the cleaning blade is equal to or larger than the dimension of a standard test piece of JIS K 6255, the measurement described above is performed by cutting out apiece of which the dimension is equal to the dimension of the test piece from the member. Meanwhile, in a case where the size of the non-contacting member is smaller than the dimension of the test piece, a test piece is formed with the same material as the member, and the measurement is performed for the test piece.

The physical property value of 50° C. impact resilience of the non-contacting member tends to become larger by improving crosslink concentration due to trifunctionalization or increase of cross-linking agents.

However, the adjustment of the 50° C. impact resilience is not limited to the method described above.

The numerical value of the 50° C. impact resilience of the non-contacting member is more preferably equal to or less than 70%, and further preferably equal to or less than 65%. In addition, the lower limit value thereof is more preferably equal to or more than 20%, and further preferably equal to or more than 25%.

Permanent Elongation

In addition, it is preferable that the non-contacting member of the cleaning blade according to the exemplary embodiment be configured with a material having 100% permanent elongation of equal to or less than 1.0%.

By providing a non-contacting member with 100% permanent elongation in the range described above, generation of settling (permanent deformation) is suppressed, contact pressure of the cleaning blade is maintained, and as a result, an excellent cleaning property is maintained.

Herein, a method of measuring the 100% permanent elongation (%) will be described.

A strip test piece is used according to JIS K 6262 (1997) and 100% tensile strain is applied and the strip test piece is left for 24 hours, and the measurement is performed with gauge lengths as the following equation.

$$Ts=(L2-L0)/(L1-L0)\times 100$$

Ts: permanent elongation

L0: gauge length before applying tension

L1: gauge length at the time of applying tension

L2: gauge length after applying tension

In addition, in a case where the size of the non-contacting member of the cleaning blade is equal to or larger than the dimension of the standard strip test piece of JIS K 6262, the measurement is performed by cutting out apiece of which the dimension is equal to the dimension of the strip test piece from the member. Meanwhile, in a case where the size of the non-contacting member is smaller than the dimension of the strip test piece, a strip test piece is formed with the same material as the member, and the measurement described above is performed for the strip test piece.

The physical property value of the 100% permanent elongation of the non-contacting member tends to becomes larger by adjusting amounts of cross-linking agents, or molecular weight of polyol if the non-contacting member is polyurethane.

However, the adjustment of the 100% permanent elongation is not limited to the method described above.

The numerical value of the 100% permanent elongation of the non-contacting member is more preferably equal to or less than 1.0%, and further preferably equal to or less than 0.9%.

As a material used for the non-contacting member, polyurethane rubber, silicon rubber, fluoro-rubber, chloroprene rubber, butadiene rubber, or the like is used, for example. The polyurethane rubber is preferable among the above materials. As the polyurethane rubber, ester based polyurethane and ether based polyurethane are used, and ester based polyurethane is particularly preferable.

In addition, in a case of manufacturing the polyurethane rubber, there is a method using polyol and polyisocyanate.

As polyol, polytetramethylether glycol, polyethylene adipate, polycaprolactone or the like is used.

As polyisocyanate, 2,6-toluene diisocyanate (TDI), 4,4'-diphenyl methane diisocyanate (MDI), paraphenylene diisocyanate (PPDI), 1,5-naphthalene diisocyanate (NDI), 3,3-dimethyldiphenyl-4,4-diisocyanate (TODI) or the like is used. Among them, MDI is preferable.

In addition, as a curing agent for curing polyurethane, a curing agent such as 1,4-butanediol or trimethylolpropane, ethylene glycol, or a mixture thereof is used.

To describe the exemplary embodiment with a detailed example, it is preferable that a combination of 1,4-butanediol and trimethylolpropane as curing agents are used with prepolymer generated by mixing and reacting diphenyl methane-4,4-diisocyanate with respect to polytetramethylether glycol which has been subjected to a dewatering process. In addition, an additive such as a reaction conditioning agent may be added thereto.

As a method of manufacturing the non-contacting member, a well-known method of the related art is used according to raw materials used for the manufacturing, and for example, the member is prepared by forming sheets using the centrifugal molding, the extrusion molding, or the like and performing a cut process in a predetermined shape.

Manufacture of Cleaning Blade

In addition, in a case of the multiple-layer configuration such as the two-layer configuration shown in FIG. 2, the cleaning blade is manufactured by sticking a first layer and a second layer (plural layers in a case of a layer configuration with three layers or more) obtained with the method described above, together. As the sticking method, a double-faced tape, various adhesive agents or the like is suitably used. In addition, the plural layers may be adhered to each other by pouring materials of each layer into a mold with a time difference when molding and bonding each material without providing adhesive layers.

In a case of a configuration including the contacting member (edge) and the non-contacting member (rear surface) shown in FIG. 3, a first mold including a cavity (a region in which a composition for formation of the contacting member is poured) corresponding to a semicircular columnar shape which is obtained by overlapping the ventral surface 3C sides of two contacting members 3421C shown in FIG. 3, and a second mold including a cavity corresponding to a shape obtained by overlapping the ventral surface 3C sides of two of each contacting member 3421C and non-contacting member 3422C, are prepared. A first molded material having a shape obtained by overlapping two contacting members 3421C each other is formed by pouring the composition for formation of the contacting member into the cavity of the first mold and curing it. Then, after extracting the first mold, the second mold is installed so as to dispose the first molded material inside the cavity of the second mold. Next, a second molded material having a shape obtained by overlapping the ventral surface 3C sides of two of each contacting member 3421C and non-contacting member 3422C, is formed by pouring a composition for formation of the non-contacting member into the cavity of the second mold and curing the composition so as to cover the first molded material. Then, the center of the formed second molded material, that is, the portion to be the ventral surface 3C is cut, the center of the contacting member with a semicircular columnar shape is segmented and cut so as to be a shape of quarter-cut column, and further cut to obtain the predetermined dimension, and thus, the cleaning blade shown in FIG. 3 is obtained.

In addition, a thickness of the entire cleaning blade is preferably from 1.5 mm to 2.5 mm, and more preferably from 1.8 mm to 2.2 mm.

Purpose

When cleaning the member to be cleaned using the cleaning blade of the exemplary embodiment, as the member to be cleaned which is the target for cleaning, it is not particularly limited as long as it is a member of which a surface is necessary to be cleaned in the image forming apparatus. For example, an intermediate transfer member, a charging roller, a transfer roller, a transporting belt for material to be transferred, paper transporting roller, a detoning roller for removing toner from a cleaning brush for removing toner from an image holding member, and the like are exemplified, however, in the exemplary embodiment, the image holding member is particularly preferable.

Cleaning Device, Process Cartridge and Image Forming Apparatus

Next, a cleaning device, a process cartridge, and an image forming apparatus using the cleaning blade of the exemplary embodiment will be described.

The cleaning device of the exemplary embodiment is not particularly limited as long as it includes the cleaning blade of the exemplary embodiment as a cleaning blade which comes in contact with a surface of a member to be cleaned and cleans the surface of the member to be cleaned. For example, as a configuration example of the cleaning device, a configuration, in which the cleaning blade is fixed so that an edge tip faces an opening portion side in a cleaning case including an opening portion on a side of the member to be cleaned and a transporting member which guides foreign materials such as waste toner collected from the surface of the member to be cleaned by the cleaning blade to a foreign material collecting container is included, is used. In addition, two or more cleaning blades of the exemplary embodiment may be used in the cleaning device of the exemplary embodiment.

In a case of using the cleaning blade of the exemplary embodiment to clean the image holding member, in order to suppress an image deletion when forming an image, a force NF (Normal Force) to press the cleaning blade against the image holding member is preferably in a range from 1.3 gf/mm to 2.3 gf/mm, and more preferably in a range from 1.6 gf/mm to 2.0 gf/mm.

In addition, a length of a tip portion of the cleaning blade held in the image holding member is preferably in a range from 0.8 mm to 1.2 mm, and more preferably in a range from 0.9 mm to 1.1 mm.

An angle W/A (Working Angle) of the contacting portion of the cleaning blade and the image holding member is preferably in a range from 8° to 14°, and more preferably in a range from 10° to 12°.

Meanwhile, the process cartridge of the exemplary embodiment is not particularly limited as long as it includes the cleaning device of the exemplary embodiment as the cleaning device which comes in contact with surfaces of one or more members to be cleaned such as the image holding member, the intermediate transfer member, and the like and cleans the surfaces of the members to be cleaned, and for example, a process cartridge, that includes the image holding member and the cleaning device of the exemplary embodiment which cleans the surface of the image holding member and that is detachable from the image forming apparatus, is exemplified. For example, if it is a so-called tandem machine including the image holding member corresponding to toner of each color, the cleaning device of the exemplary embodiment may be provided for each image holding member. In addition, other than the cleaning device of the exemplary embodiment, a cleaning brush or the like may be used together.

Detailed Examples of Cleaning Blade, Image Forming Apparatus, and Cleaning Device Next, detailed examples of the cleaning blade and image forming apparatus and the cleaning device using the cleaning blade of the exemplary embodiment will be described with reference to the drawing.

Figure 4:
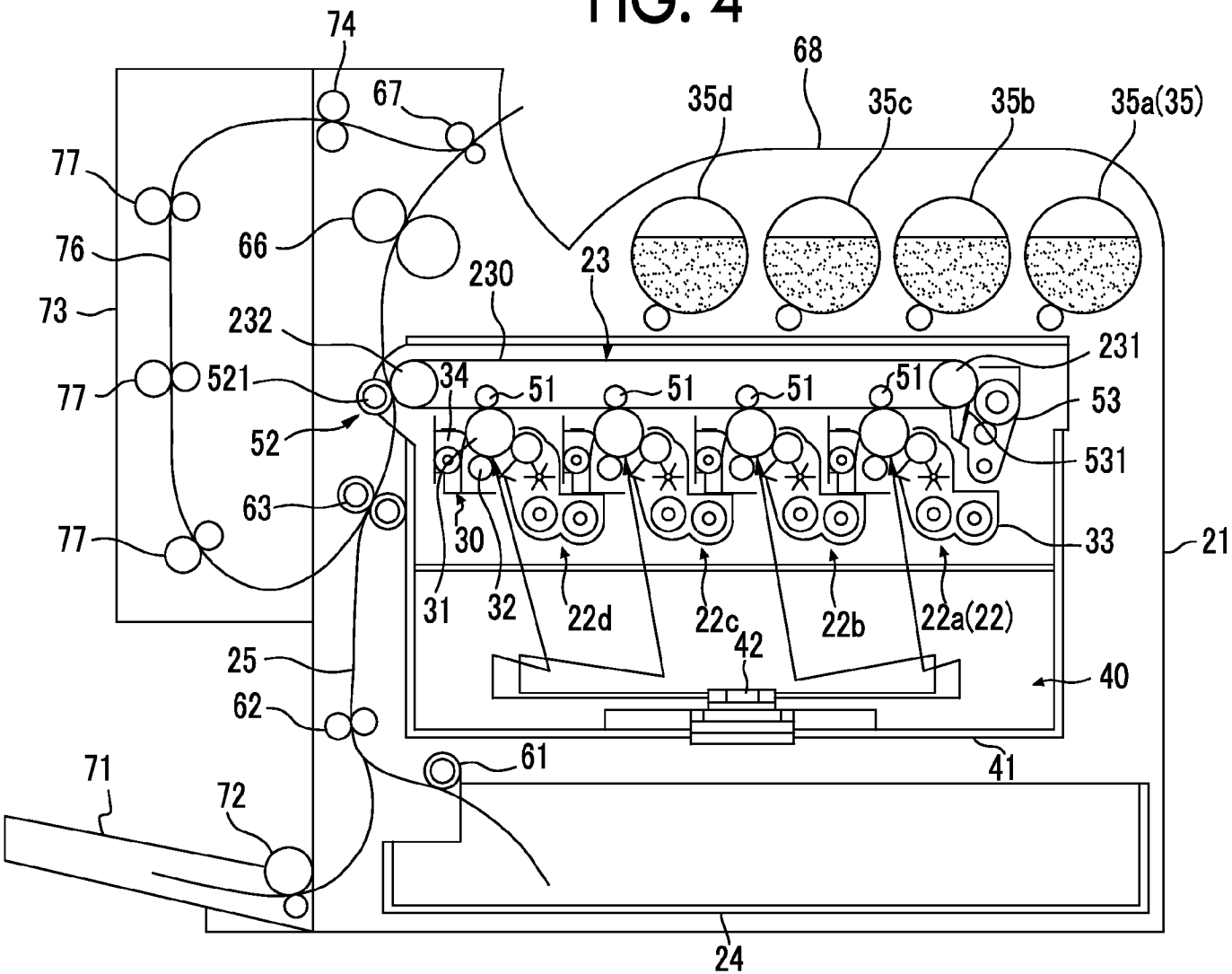
FIG. 4 is a perspective schematic view showing an example of an image forming apparatus according to an exemplary embodiment.

FIG. 4 is a perspective schematic view showing an example of the image forming apparatus according to the exemplary embodiment, and shows a so-called tandem type image forming apparatus.

In FIG. 4, reference numeral 21 denotes a main member housing, reference numerals 22 and 22*a* to 22*d* denote image forming engines, reference numeral 23 denotes a belt module, reference numeral 24 denotes a recording medium supply cassette, reference numeral 25 denotes a recording medium transporting path, reference numeral 30 denotes each photoreceptor unit, reference numeral 31 denotes a photoreceptor drum, reference numeral 33 denotes each developing unit, reference numeral 34 denotes a cleaning device, reference numerals 35 and 35*a* to 35*d* denote toner cartridges, reference numeral 40 denotes an exposing unit, reference numeral 41 denotes a unit case, reference numeral 42 denotes a polygon mirror, reference numeral 51 denotes a primary transfer unit, reference numeral 52 denotes a secondary transfer unit, reference numeral 53 denotes a belt cleaning device, reference numeral 61 denotes a sending-out roller and reference numeral 62 denotes a transporting roller, reference numeral 63 denotes a positioning roller, reference numeral 66 denotes a fixing device, reference numeral 67 denotes a discharge roller, reference numeral 68 denotes a paper discharge unit, reference numeral 71 denotes a manual feeder, reference numeral 72 denotes a sending-out roller, reference numeral 73 denotes a double side recording unit, reference numeral 74 denotes a guide roller, reference numeral 76 denotes a transporting path, reference numeral 77 denotes a transporting roller, reference numeral 230 denotes an intermediate transfer belt, reference numerals 231 and 232 denote support rollers, reference numeral 521 denotes a secondary transfer roller, and reference numeral 531 denotes a cleaning blade.

In the tandem type image forming apparatus shown in FIG. 4, the image forming engines 22 (in detail, 22*a* to 22*d*) of four colors (in the exemplary embodiment, black, yellow, magenta, and cyan) are arranged in the main member housing 21, and on the upper portion thereof, the belt module 23 in which the intermediate transfer belt 230 which circulation-transports along the arrangement direction of each image forming engine 22 is included, is disposed. Meanwhile, the recording medium supply cassette 24, in which a recording medium (not shown), such as paper, is accommodated is disposed on the lower portion of the main member housing 21, and the recording medium transporting path 25, which is a transporting path of the recording medium from the recording medium supply cassette 24, is disposed in a vertical direction.

In the exemplary embodiment, each image forming engine (22*a* to 22*d*) sequentially forms toner images for black, yellow, magenta, and cyan (arrangement is not particularly limited to this order), from upstream in a circulation direction of the intermediate transfer belt 230, and includes each photoreceptor unit 30, each developing unit 33, and one common exposing unit 40.

Herein, each photoreceptor unit 30 is obtained by arranging the photoreceptor drum 31, a charging device (charging roller) 32 which charges the photoreceptor drum 31 in advance, and the cleaning device 34 which removes remaining toner on the photoreceptor drum 31 integrally as sub-cartridges, for example.

In addition, the developing units 33 develop an electrostatic latent image formed by exposing in the exposing unit 40 on the charged photoreceptor drum 31 with the corresponding colored toner (in the exemplary embodiment, for example, negative polarity), and configure the process cartridge (so-called customer replaceable unit) by being integrated with the sub-cartridge formed of the photoreceptor unit 30, for example.

Further, the photoreceptor unit 30 may be separated from the developing unit 33 and used alone as the process cartridge. In addition, in FIG. 4, reference numerals 35 (35*a* to 35*d*) are toner cartridges (toner supplying path is not shown) for supplying each color component toner to each developing unit 33.

Meanwhile, the exposing unit 40 is disposed to accommodate, for example, four semiconductor lasers (not shown), one polygon mirror 42, an imaging lens (not shown), and each mirror (not shown) corresponding to each photoreceptor unit 30 in the unit case 41, to scan light from the semiconductor laser for each color component with deflection by the polygon mirror 42, and to guide an optical image to an exposing point on the corresponding photoreceptor drum 31 through the imaging lens and mirrors.

In addition, in the exemplary embodiment, the belt module 23 includes the intermediate transfer belt 230 mounted on and extending between a pair of support rollers (one roller is a driving roller) 231 and 232, and each primary transfer unit (in this example, primary transfer roller) 51 is disposed on the back surface of the intermediate transfer belt 230 corresponding to the photoreceptor drum 31 of each photoreceptor unit 30. Since a voltage having reverse polarity with charging polarity of toner is applied to the primary transfer unit 51, the toner image on the photoreceptor drum 31 is electrostatically transferred to the intermediate transfer belt 230 side. Further, the secondary transfer unit 52 is disposed on a portion corresponding to the support roller 232 on the downstream of the image forming engine 22*d* which is on the most downstream of the intermediate transfer belt 230, and performs secondary transfer (collective transfer) of the primary transfer image on the intermediate transfer belt 230 to a recording medium.

In the exemplary embodiment, the secondary transfer unit 52 includes the secondary transfer roller 521 which is disposed to be pressure-welded on the toner image holding surface side of the intermediate transfer belt 230, and a back surface roller (in this example, also used as the support roller 232) which is disposed on the rear surface of the intermediate transfer belt 230 to be formed as an opposite electrode of the secondary transfer roller 521. In addition, for example, the secondary transfer roller 521 is grounded, and bias having the same polarity with the charging polarity of the toner is applied to the back surface roller (support roller 232).

In addition, the belt cleaning device 53 is disposed on the upstream of the image forming engine 22*a* which is on the most upstream of the intermediate transfer belt 230, and removes the remaining toner on the intermediate transfer belt 230.

In addition, the sending-out roller 61 which picks up a recording medium is disposed on the recording medium supply cassette 24, the transporting roller 62 which sends out the recording medium is disposed right behind the send-out roller 61, and a registration roller (positioning roller) 63 which supplies the recording medium to the secondary transfer portion at a predetermined timing is disposed on the recording medium transporting path 25 which positions right in front of the secondary transfer portion. Meanwhile, the fixing device 66 is disposed on the recording medium transporting path 25 which is positioned on the downstream of the secondary transfer portion, the discharge roller 67 for discharge of the recording medium is disposed on downstream of the fixing device 66, and the discharged recording medium is accommodated in the paper discharge unit 68 formed on the upper portion of the main member housing 21.

In addition, in the exemplary embodiment, the manual feeder (MSI) 71 is disposed on the side of the main member housing 21, and the recording medium on the manual feeder 71 is sent towards the recording medium transporting path 25 through the sending-out roller 72 and the transporting roller 62.

In addition, the double side recording unit 73 is provided in the main member housing 21. When a double side mode which performs image recording on double sides of a recording medium is selected, the double side recording unit 73 reverses a recording medium with the single side recorded by the discharge roller 67. And the recording medium is brought to the inner portion through the guide roller 74 in front of an inlet, the recording medium in the inner portion is brought back through the transporting rollers 77, the recording medium is transported along the transporting path 76, and supplied to the positioning roller 63 side again.

Next, the cleaning device 34 which is disposed in the tandem type image forming apparatus shown in FIG. 4 will be described in detail.

Figure 5:
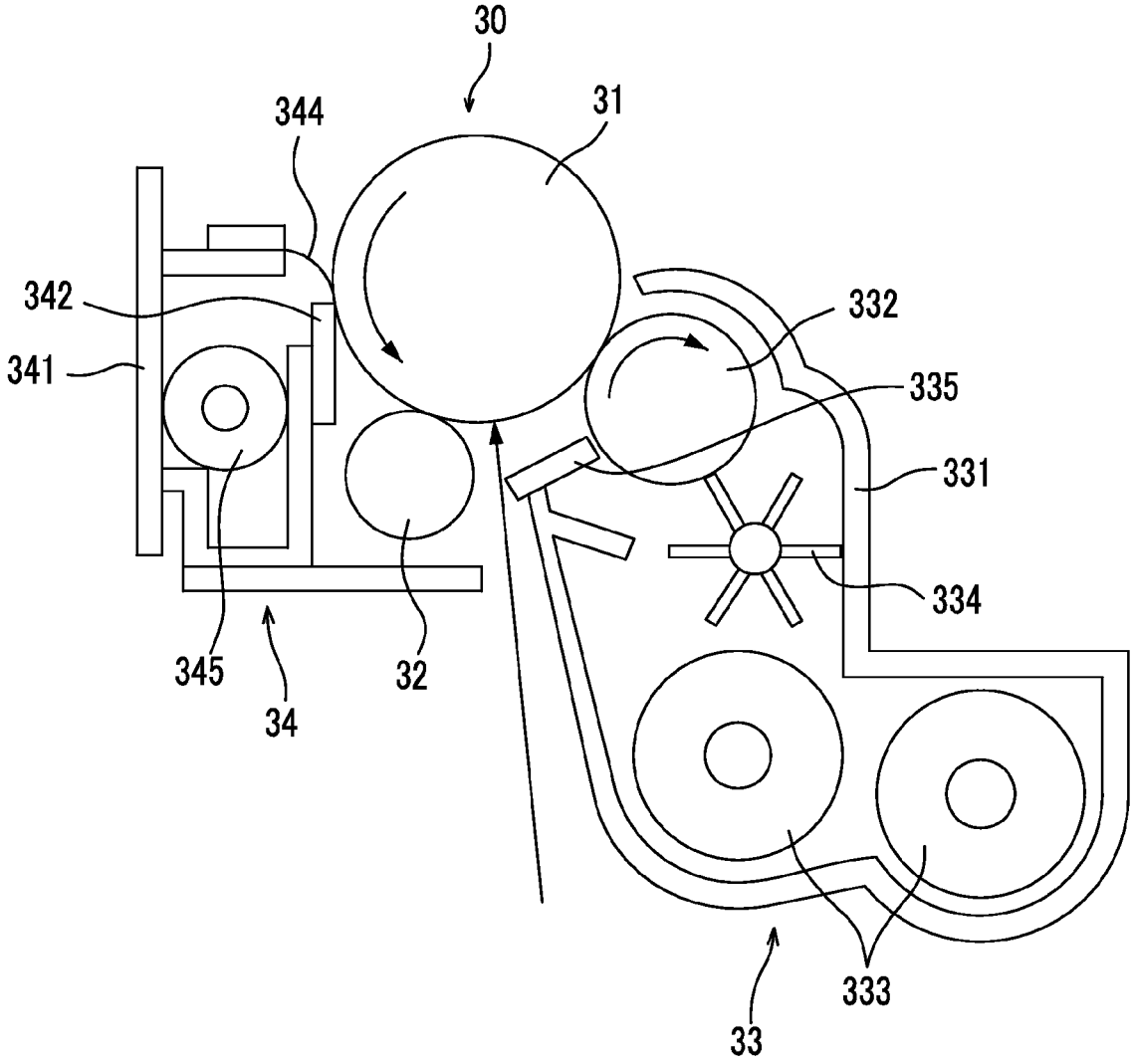
FIG. 5 is a schematic cross-sectional view showing an example of a cleaning device according to an exemplary embodiment.

FIG. 5 is a schematic cross-sectional view showing an example of the cleaning device of the exemplary embodiment, and is a view showing the cleaning device 34, the photoreceptor drum 31 as the sub-cartridge, the charging roller 32, and the developing unit 33 shown in FIG. 4.

In FIG. 5, reference numeral 32 denotes the charging roller (charging device), reference numeral 331 denotes a unit case, reference numeral 332 denotes a developing roller, reference numerals 333 denote toner transporting members, reference numeral 334 is a transporting paddle, reference numeral 335 is a trimming member, reference numeral 341 denotes a cleaning case, reference numeral 342 denotes a cleaning blade, reference numeral 344 denotes a film seal, and reference numeral 345 denotes a transporting member.

The cleaning device 34 includes the cleaning case 341 which accommodates the remaining toner and which is open facing the photoreceptor drum 31, and in the cleaning device 34, the cleaning blade 342 which is disposed to come in contact with the photoreceptor drum 31 is attached to the lower edge of the opening of the cleaning case 341 through a bracket (not shown). Meanwhile, the film seal 344 which keeps air tightness with respect to the photoreceptor drum 31 is attached to the upper edge of the opening of the cleaning case 341. In addition, reference numeral 345 denotes a transporting member which guides waste toner accommodated in the cleaning case 341 to a waste toner container on the side.

Next, the cleaning blade provided in the cleaning device 34 will be described in detail with reference to the drawing.

FIG. 1 is a schematic cross-sectional view showing an example of the cleaning blade of the exemplary embodiment, and is a view showing the cleaning blade 342 shown in FIG. 5 and the photoreceptor drum 31 which comes in contact thereto.

In addition, in the exemplary embodiment, in all cleaning devices 34 of respective image forming engines 22 (22*a* to 22*d*), the cleaning blade of the exemplary embodiment is used as the cleaning blade 342, and the cleaning blade of the exemplary embodiment may be used for the cleaning blade 531 used in the belt cleaning device 53.

In addition, as shown in FIG. 5, for example, the developing unit (developing device) 33 used in the exemplary embodiment includes the unit case 331 which accommodates a developer and opens facing the photoreceptor drum 31. Herein, the developing roller 332 is disposed on the portion which faces the opening of the unit case 331, and toner transporting members 333 for stirring and transporting of the developer are disposed in the unit case 331. Moreover, the transporting paddle 334 may be disposed between the developing roller 332 and the toner transporting member 333.

When developing, after supplying the developer to the developing roller 332, the developer is transported to a developing area facing the photoreceptor drum 31 in a state where the layer thickness of the developer is regulated in the trimming member 335, for example.

In the exemplary embodiment, as the developing unit 33, a two-component developer formed of toner and a carrier for example, is used, however, a one-component developer formed only of the toner may be used.

Next, an operation of the image forming apparatus according to the exemplary embodiment will be described. First, when respective image forming engines 22 (22*a* to 22*d*) form single-colored toner images corresponding to each color, the single-colored toner images of each color are sequentially superimposed so as to match with original document information and subjected to primary transfer to the surface of the intermediate transfer belt 230. Next, the colored toner images transferred to the surface of the intermediate transfer belt 230 is transferred to the surface of the recording medium by the secondary transfer unit 52, and the recording medium to which the colored toner image is transferred is subjected to a fixing process by the fixing device 66, and then, is discharged to the paper discharge unit 68.

Meanwhile, in the respective image forming engines 22 (22*a* to 22*d*), the remaining toner on the photoreceptor drum 31 is cleaned by the cleaning device 34, and the remaining toner on the intermediate transfer belt 230 is cleaned by the belt cleaning device 53.

In such image forming process, each remaining toner is cleaned by the cleaning device 34 (or belt cleaning device 53).

In addition, the cleaning blade 342 may be fixed with a spring material, other than being directly fixed with a frame member in the cleaning device 34 as shown in FIG. 5.

EXAMPLES

Hereinafter, Examples of the invention will be described in detail, however the invention is not limited only to the following examples. In addition, in the description below, a "part" refers to a "part by weight".

A: Relationship between Dynamic Ultra Micro Hardness and Scrape of Toner

Reference Comparative Example A1

Cleaning Blade A1

Formation of Contacting Member (Edge)

First, polycaprolactone polyol (PLACCEL 205 manufactured by Daicel Corporation with an average molecular weight of 529 and a hydroxyl value of 212 KOHmg/g) and polycaprolactone polyol (PLACCEL 240 manufactured by Daicel Corporation with an average molecular weight of 4155 and a hydroxyl value of 27 KOHmg/g) are used as the soft segment materials of polyol components. In addition, the soft segment materials and the hard segment materials are mixed with a ratio of 8:2 (weight ratio) by using the acrylic resin including two or more hydroxyl groups (ACTFLOW UMB-2005B manufactured by Soken Chemical & Engineering Co., Ltd.) as the hard segment material.

Next, 6.26 parts of 4,4'-diphenyl methane diisocyanate (MILLIONATE MT manufactured by Nippon Polyurethane Industry Co., Ltd.) as the isocyanate compound is added to 100 parts of the mixture of the soft segment materials and the hard segment material, and the resultant mixture is reacted under a nitrogen atmosphere at 70° C. for three hours. In addition, the amount of the isocyanate compound used for this reaction is selected so that a ratio (isocyanate groups/hydroxyl group) of the isocyanate groups with respect to the hydroxyl group included in a reaction system becomes 0.5.

Next, 34.3 parts of the isocyanate compounds are further added thereto, and the resultant mixture is reacted under a nitrogen atmosphere at 70° C. for three hours, and prepolymer is obtained. In addition, the entire amounts of the isocyanate compounds used when using the prepolymer are 40.56 parts.

Next, the temperature of the prepolymer is increased to 100° C., and the prepolymer is subjected to defoaming for one hour under the reduced pressure. After that, 7.14 parts of mixture (weight ratio=60/40) of 1,4-butanediol and trimethylolpropane are added to 100 parts of prepolymer and mixed for three minutes without foaming, and a composition A1 for contacting member formation is prepared.

Next, the composition A1 for contacting member formation is poured into the centrifugal molding machine in which a mold (mold including the cavity corresponding to the semicircular columnar shape which is obtained by overlapping two contacting members 3421C shown in FIG. 3) is adjusted at 140° C., and subjected to the curing reaction for one hour. Next, the composition is cross-linked at 110° C. for 24 hours, and cooled to form a contacting member (edge) having a semicircular columnar shape.

Formation of Non-Contacting Member (Rear Surface)

A material in which 1,4-butanediol and trimethylolpropane are used as curing agents with prepolymer generated by mixing diphenyl methane-4,4-diisocyanate with respect to polytetramethylether glycol which was subjected to a dewatering process and performing a reaction at 120° C. for 15 minutes, is used as a composition A1 for non-contacting member formation.

In addition, adhesion of the contacting member (edge) and the non-contacting member (rear surface) is performed by pouring and curing the composition A1 for the non-contacting member formation into a centrifugal molding machine in which the contacting member is already formed in a semicircular columnar shape as described above.

The member obtained by adhering the contacting member (edge) and the non-contacting member (rear surface) is cooled after cross-linking at 110° C. for 24 hours and the center thereof is cut, such that the center of the contacting member (edge) having a semicircular columnar shape is segmented and cut so as to be a shape of quarter-cut column, and further cut to obtain a length of 8 mm and a thickness of 2 mm. Accordingly, a cleaning blade A1 with an edge-rear surface configuration in that the contacting member (edge) has a shape (shape shown in FIG. 3) of quarter-cut column and the other portion thereof is formed with the non-contacting member (rear surface), is obtained.

In addition, when dynamic ultra micro hardness, 23° C. breaking elongation, 10° C. impact resilience, a $(-1)\times\tan\delta$ peak temperature, and a Young's modulus of the contacting member (edge) are measured with the method described above and an index K is calculated, the results are as shown in Table 1 below. Reference Examples A1 to A12 and Reference Comparative Examples A2 to A3

A cleaning blade having dynamic ultra micro hardness different from that of Reference Comparative Example A1 is manufactured.

In detail, a cleaning blade is obtained with the method described for Reference Comparative Example 1 except that the dynamic ultra micro hardness is adjusted so as to obtain as shown in Table 1 below by changing amount of chemical cross-linking (amounts of cross-linking points) or amounts of hard segments used in formation of the contacting member (edge) of Reference Comparative Example A1.

Evaluation Test: Toner Scrape Evaluation

With the method described below, a degree of toner scrape, due to variance of the dynamic ultra micro hardness, that is, cleaning performance is evaluated. Cleaning blades obtained in Reference Examples and Reference Comparative Examples are loaded on DocuCentre-IV C5575 manufactured by Fuji Xerox co., Ltd., NF (Normal Force) is adjusted to 1.3 gf/mm and W/A (Working Angle) is adjusted at 11°, and then 10 k sheets are printed.

If the toner scrapes through the contacting region of a cleaning blade and a photoreceptor drum, the toner is accumulated on the ventral surface (in a state where the contacting member (edge) comes in contact with the driving photoreceptor drum, surface facing downstream side of the driving direction) of the cleaning blade. Accordingly, the amount of toner accumulated on the ventral surface of the cleaning blade which is subjected to the test is measured. In addition, it is determined that the accumulated amount is suitable to be equal to or less than $15.0\times10^{-3}$ $mm^3$. The results are shown in Table 1 below.

TABLE 1

| | | Dynamic ultra micro hardness | Accumulated amount of toner [$\times10^{-3}$ $mm^3$] |
|---|---|---|---|
| Reference Examples | A1 | 0.25 | 15 |
| | A2 | 0.3 | 10 |
| | A3 | 0.32 | 8 |
| | A4 | 0.33 | 7 |
| | A5 | 0.4 | 6 |
| | A6 | 0.48 | 6 |
| | A7 | 0.49 | 7 |
| | A8 | 0.59 | 8 |
| | A9 | 0.65 | 15 |
| Reference Comparative Examples | A1 | 0.14 | 31 |
| | A2 | 0.21 | 20 |
| | A3 | 0.73 | 21 |

Figure 6:
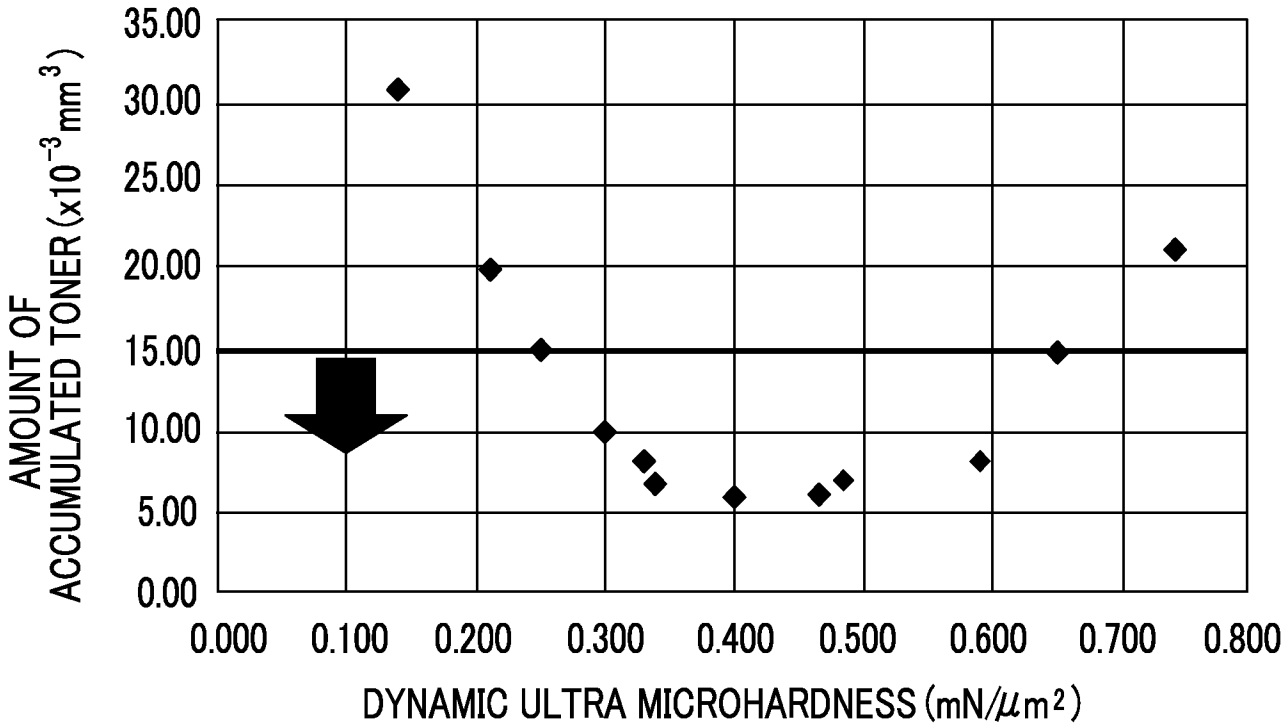
FIG. 6 is a graph showing a result of amounts of accumulated toner in Reference Example A.

In addition, FIG. 6 shows the results in a graph. B: Relationship between 4 Physical Property Values and Crack Examples B1 to B5 and Comparative Examples B1 to B4

Cleaning blades are obtained with the method described for Reference Comparative Example A1, except that various physical properties of the contacting member (edge) used in formation of the contacting member (edge) of Reference Comparative Example A1 are changed as shown in Table 2 below by adjustment of molecular weight of polyol, adjustment of amounts of cross-linking agents, adjustment of numbers of functional groups of cross-linking agents, introducing or not introducing hydrophobic polyol, increase or decrease of chemical cross-linking (cross-linking points), and adjustment of hard segment amounts.

In addition, when various physical properties of the cleaning blade are measured, the results are as shown in Table 2 below.

Example B6 and Comparative Example B5

Not the cleaning blade, which is divided into the edge and the rear surface, but a cleaning blade including a two-layer configuration with a first layer which comes in contact with a photoreceptor and a second layer on a rear surface is manufactured.

Formation of First Layer

By changing various physical properties of the contacting member (edge) used in formation of the contacting member (edge) of Reference example B1 as shown in Table 2 below by adjustment of molecular weight of polyol, adjustment of amounts of cross-linking agents, adjustment of numbers of functional groups of cross-linking agents, introducing or not introducing hydrophobic polyol, increase or decrease of chemical cross-linking (cross-linking points), and adjustment of hard segment amounts and by changing the shape to a flat plate shape (first layer) not the contacting member (edge) in a semicircular columnar shape, a first layer having various physical properties as shown in Table 2 is formed.

Formation of Second Layer

A composition A1 for second layer formation manufactured in Reference Comparative Example A1 is used as a composition for second layer.

In addition, adhesion of the first layer and the second layer is performed by pouring and curing the composition for the second layer formation into a centrifugal molding machine in which the first layer is already formed in a flat plate shape as described above, and the second layer is formed on the rear surface of the first layer, and for other than that, a cleaning blade is obtained with the method described in Comparative Example B1.

TABLE 2

| | Dynamic ultra micro hardness | 23° C. breaking elongation [%] | 10° C. impact resilience [%] | (−1) × tan δ peak temperature [° C.] | Young's modulus [MPa] | Index K | Crack grade |
|---|---|---|---|---|---|---|---|
| Example 1 | 0.330 | 284 | 37 | 41 | 25.4 | 17.0 | 4 |
| Example 2 | 0.284 | 332 | 36 | 41 | 22.2 | 22.1 | 6 |
| Example 3 | 0.326 | 220 | 46 | 42 | 17.0 | 25.1 | 9 |
| Example 4 | 0.317 | 404 | 39 | 44.8 | 26.4 | 26.8 | 9 |
| Example 5 | 0.344 | 414 | 38 | 43.9 | 24.4 | 28.3 | 10 |
| Comparative Example 1 | 0.439 | 80 | 42 | 50.6 | 27.9 | 6.1 | 1 |
| Comparative Example 2 | 0.336 | 140 | 33 | 35.2 | 19.6 | 8.3 | 1 |
| Comparative Example 3 | 0.466 | 150 | 41 | 42 | 28.1 | 9.2 | 1 |
| Comparative Example 4 | 0.661 | 160 | 42 | 41 | 23.4 | 11.8 | 1 |
| Example 6 | 0.153 | 410 | 26 | 16 | 10.1 | 16.9 | 5 |
| Comparative Example 5 | 0.331 | 230 | 18 | 16 | 12.0 | 5.5 | 1 |

Evaluation Test: Crack Evaluation

A degree (grade) of crack generation is evaluated with the following method. Cleaning blades obtained in Examples and Comparative Examples are loaded on DocuCentre-IV C5575 manufactured by Fuji Xerox co., Ltd., NF (Normal Force) is adjusted to 1.3 gf/mm and W/A (Working Angle) is adjusted at 11°, and then 10 k sheets are printed.

The degree (grade) of the crack generation is evaluated according to following criteria, with size and numbers of cracks at that time. In addition the degree (grade) of the crack generation is measured in a range of 100 mm of center portion in an axis direction.

Grade 10: No generation of cracks

Grade 9: The size of cracks is equal to or smaller than 1 μm and the numbers of cracks are equal to or more than 1 and less than 5.

Grade 8: The size of cracks is equal to or smaller than 1 μm and the numbers of cracks are equal to or more than 5 and less than 10.

Grade 7: The size of cracks is equal to or smaller than 1 μm and the numbers of cracks are equal to or more than 10.

Grade 6: The size of cracks is larger than 1 μm and equal to or smaller than 5 μm and the numbers of cracks are equal to or more than 1 and less than 5.

Grade 5: The size of cracks is larger than 1 μm and equal to or smaller than 5 μm and the numbers of cracks are equal to or more than 5 and less than 10.

Grade 4: The size of cracks is larger than 1 μm and equal to or smaller than 5 μm and the numbers of cracks are equal to or more than 10.

Grade 3: The size of cracks is larger than 5 μm and the numbers of cracks are equal to or more than 1 and less than 5.

Grade 2: The size of cracks is larger than 5 μm and the numbers of cracks are equal to or more than 5 and less than 10.

Grade 1: The size of cracks is larger than 5 μm and the numbers of cracks are equal to or more than 10.

Figure 7:
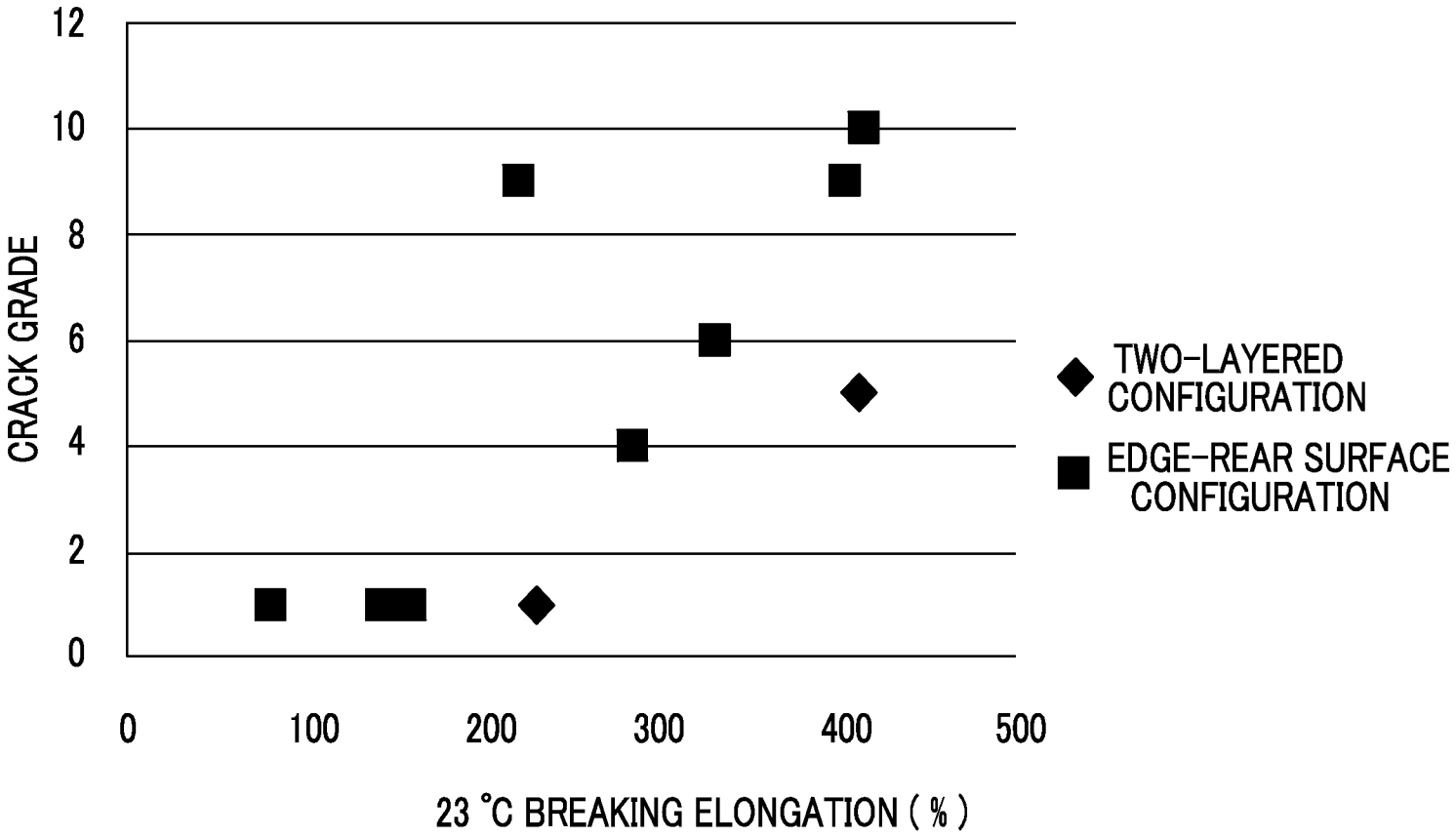
FIG. 7 is a graph showing a result of crack grades in Example B.

FIG. 7 shows the relationship between the obtained results of the crack grades and 23° C. breaking elongation in graph. As shown in FIG. 7, the result with correlation between the generation of cracks and 23° C. breaking elongation is not obtained.

Figure 8:
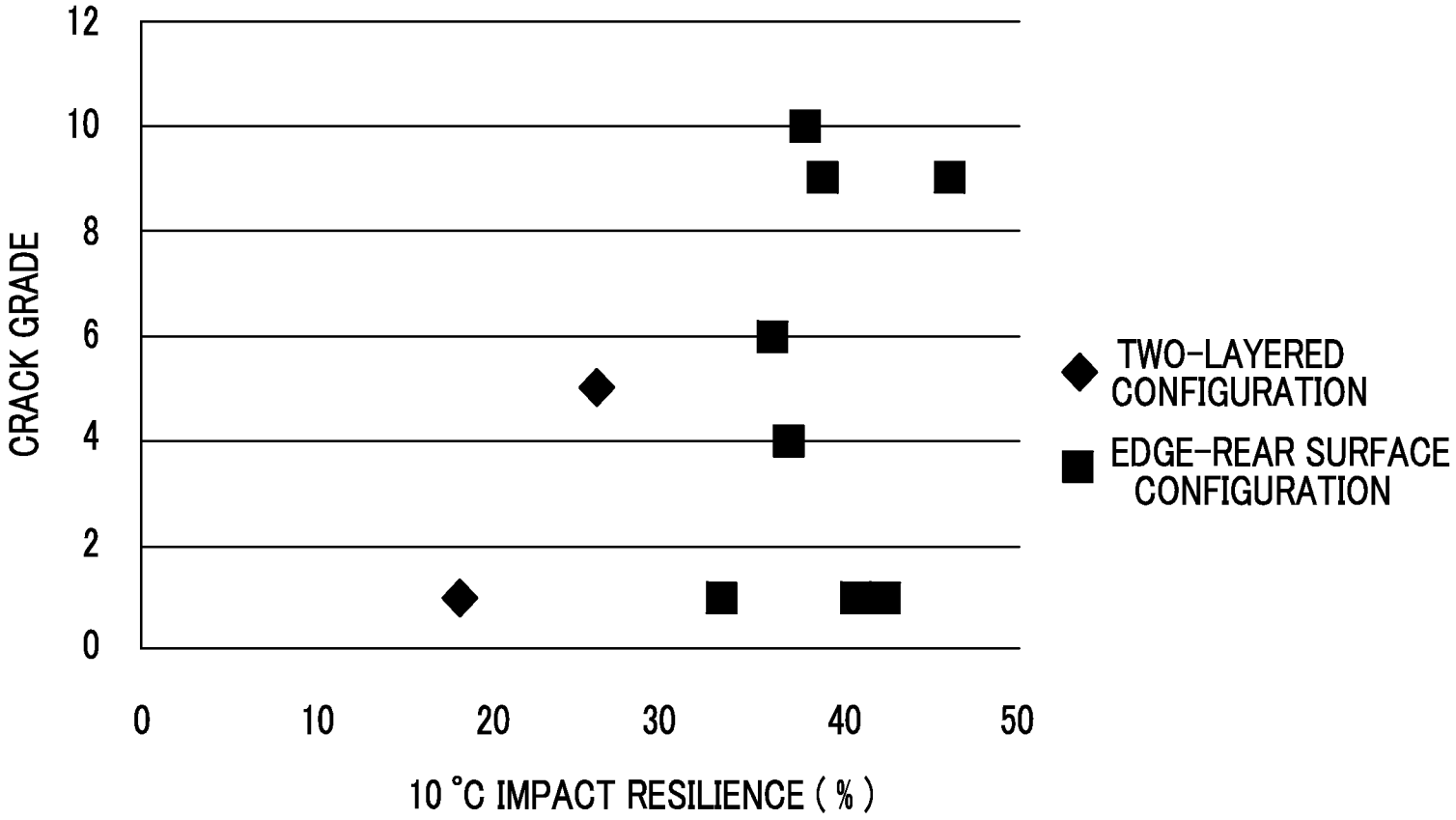
FIG. 8 is a graph showing a result of crack grades in Example B.
Figure 9:
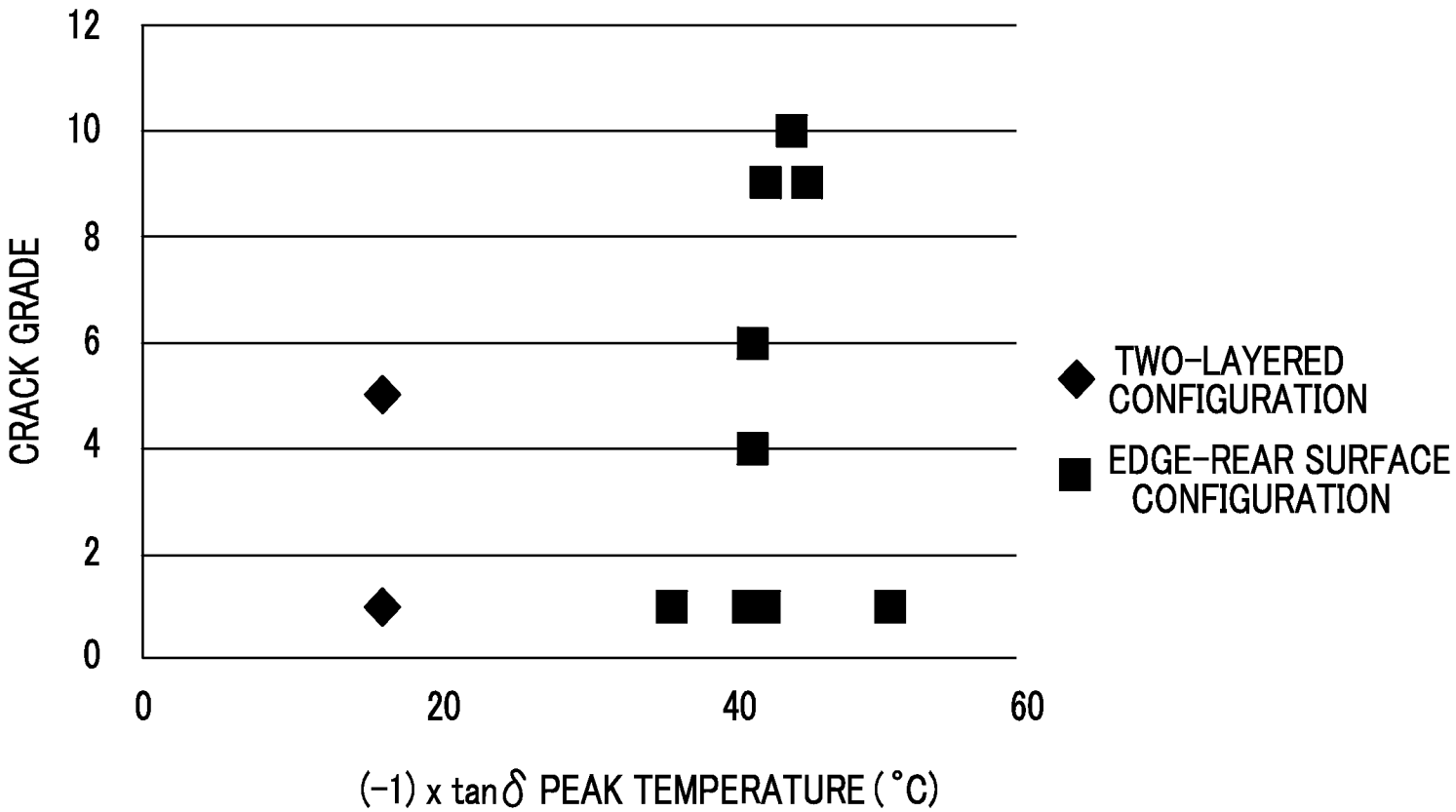
FIG. 9 is a graph showing a result of crack grades in Example B.
Figure 10:
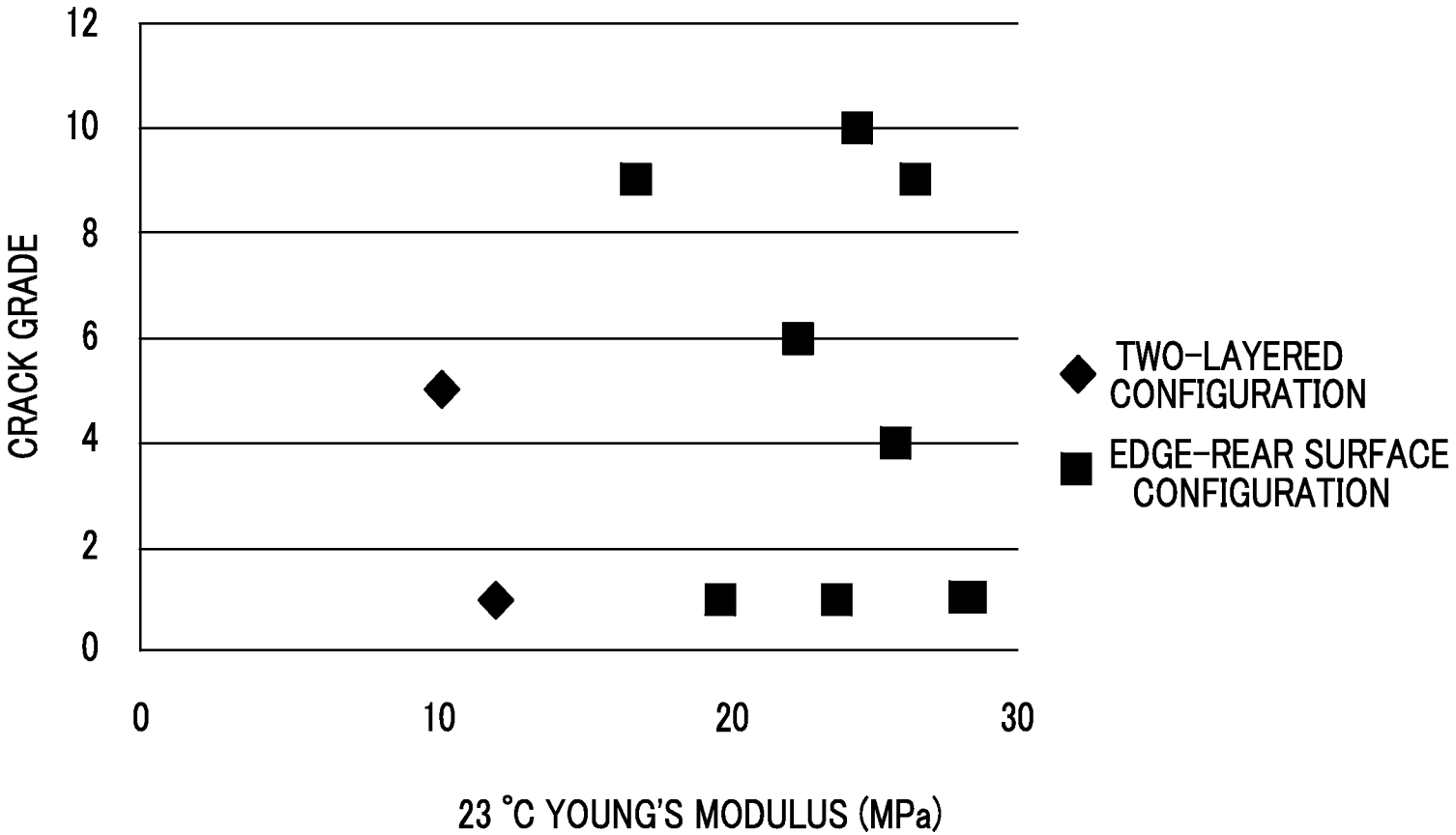
FIG. 10 is a graph showing a result of crack grades in Example B.
Figure 11:
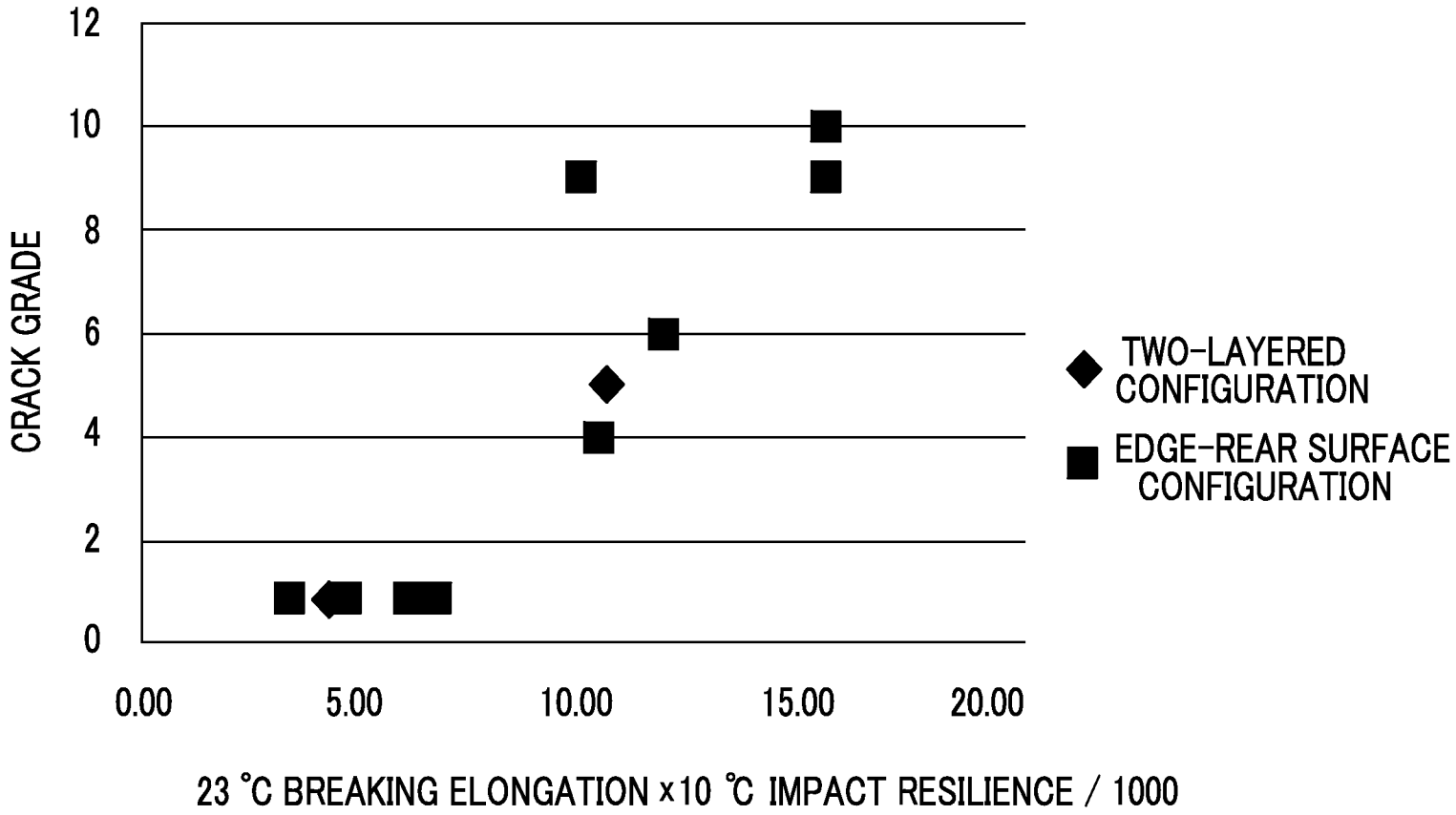
FIG. 11 is a graph showing a result of crack grades in Example B.
Figure 12:
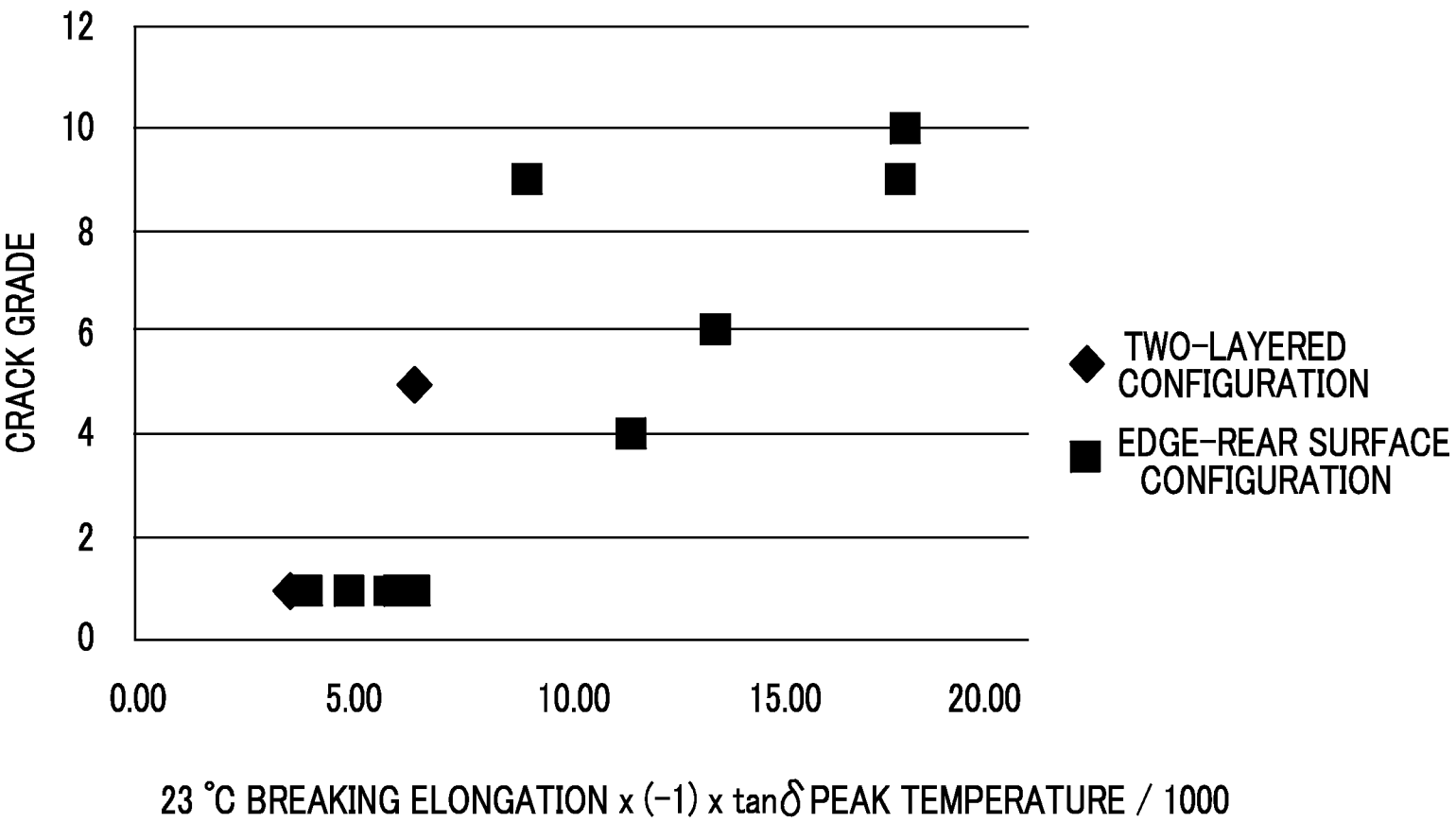
FIG. 12 is a graph showing a result of crack grades in Example B.
Figure 13:
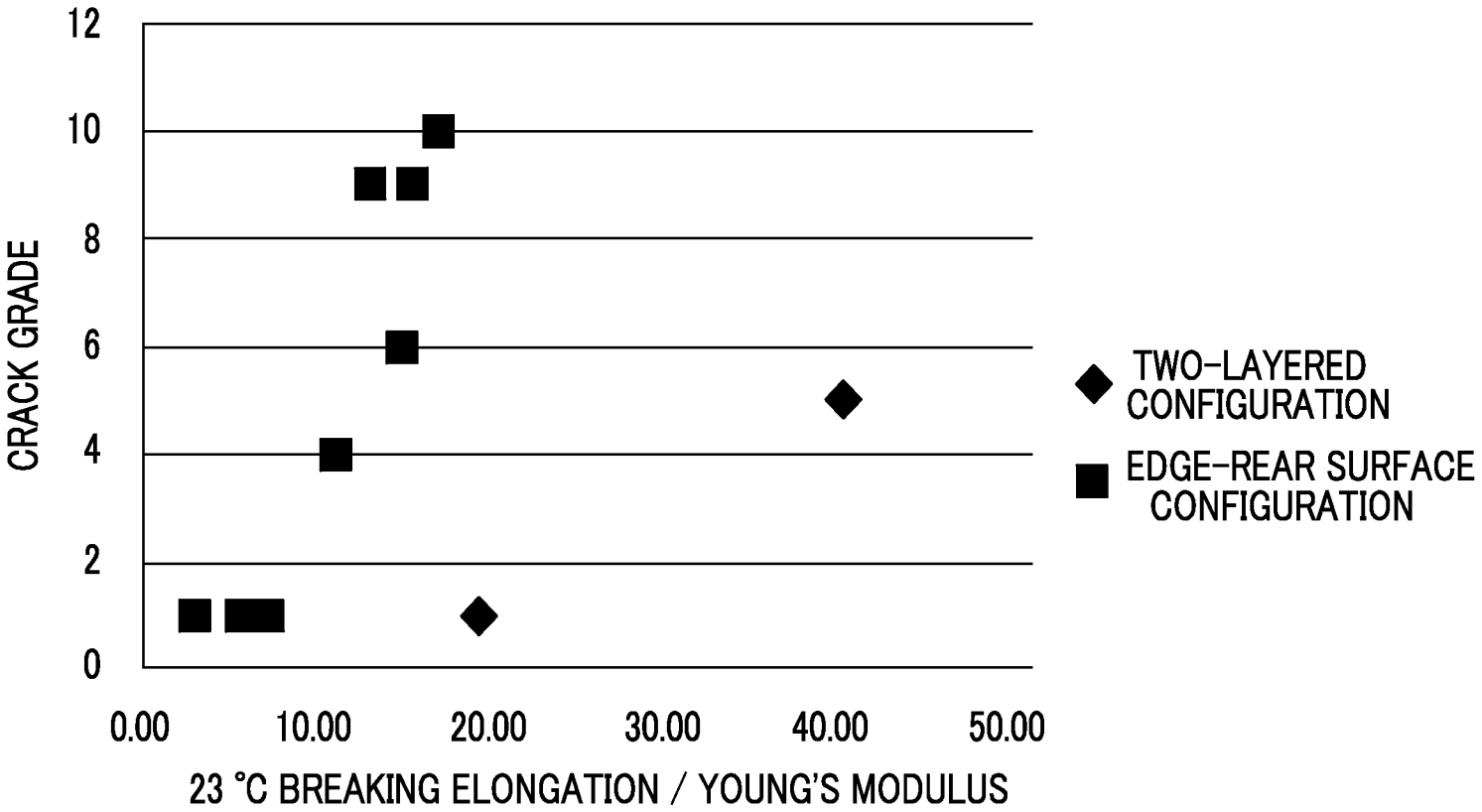
FIG. 13 is a graph showing a result of crack grades in Example B.
Figure 14:
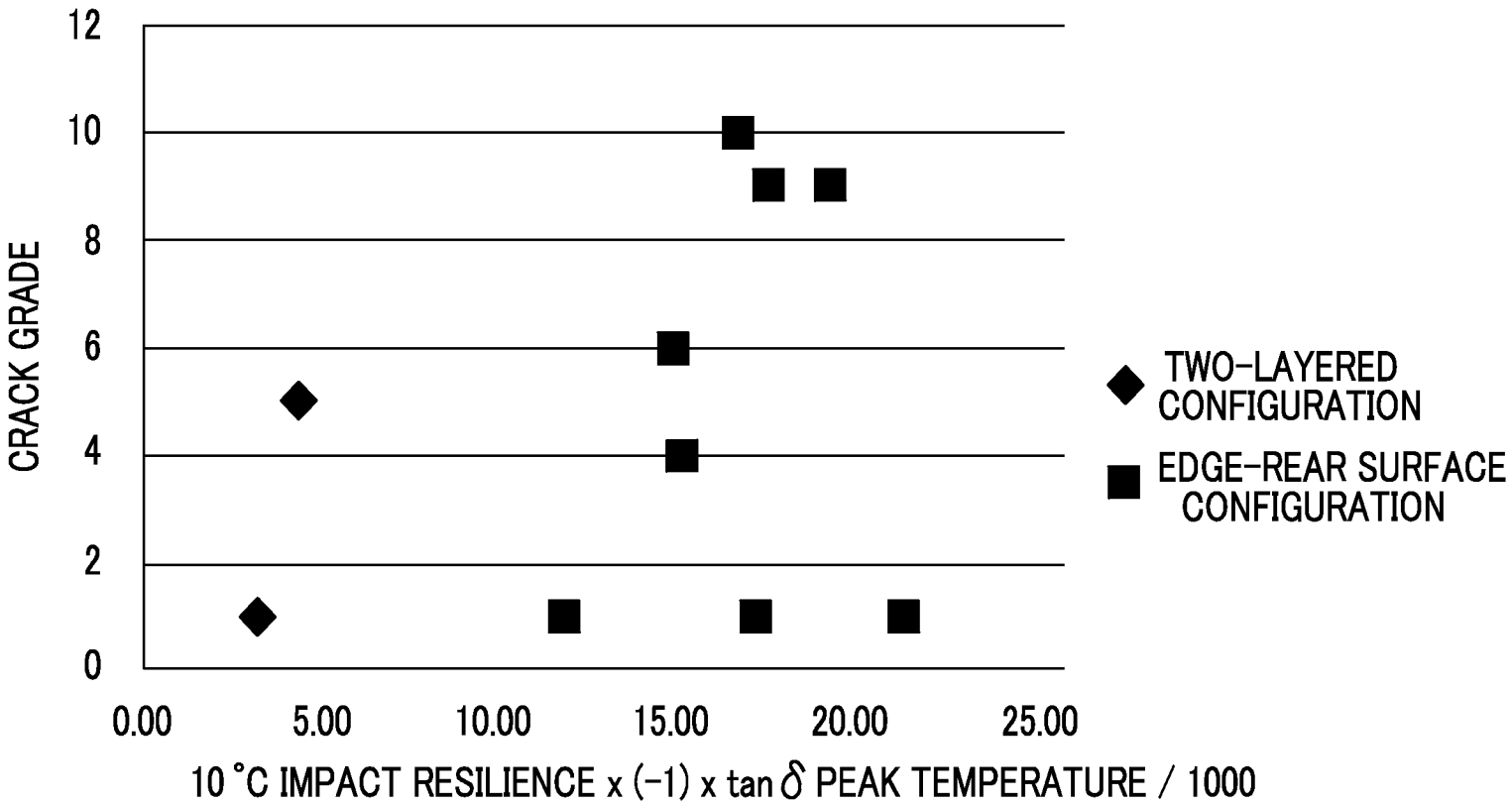
FIG. 14 is a graph showing a result of crack grades in Example B.
Figure 15:
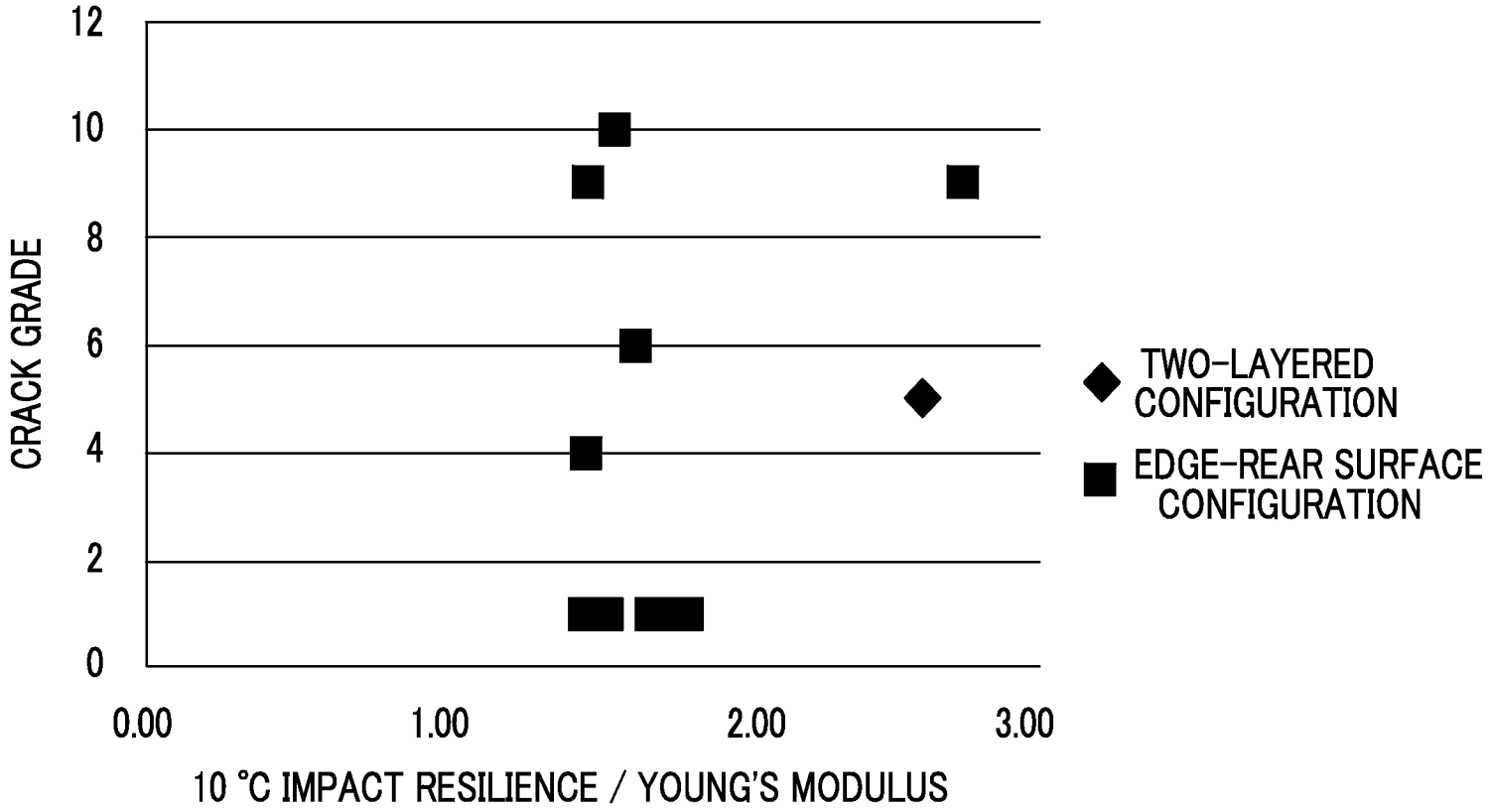
FIG. 15 is a graph showing a result of crack grades in Example B.
Figure 16:
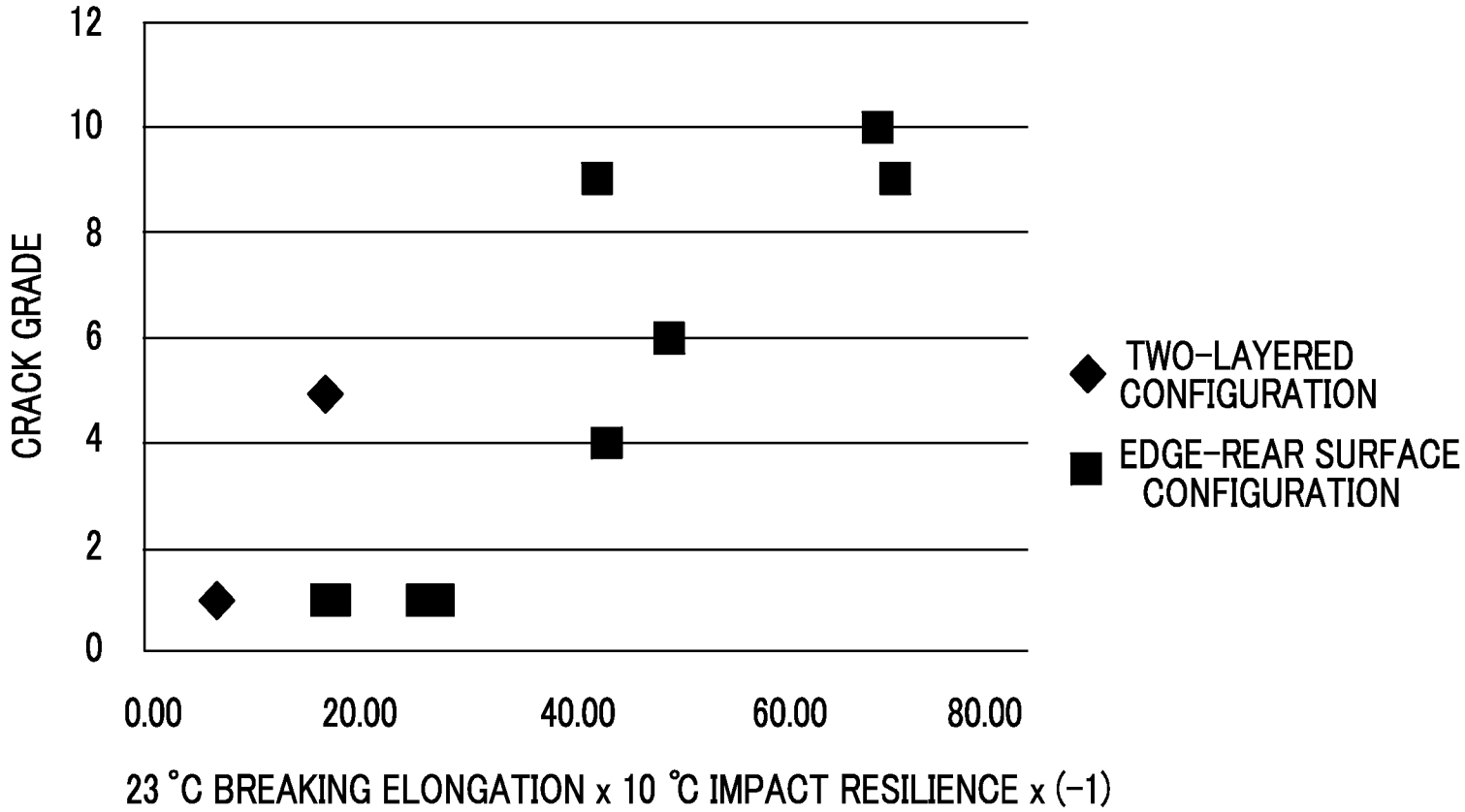
FIG. 16 is a graph showing a result of crack grades in Example B.
Figure 17:
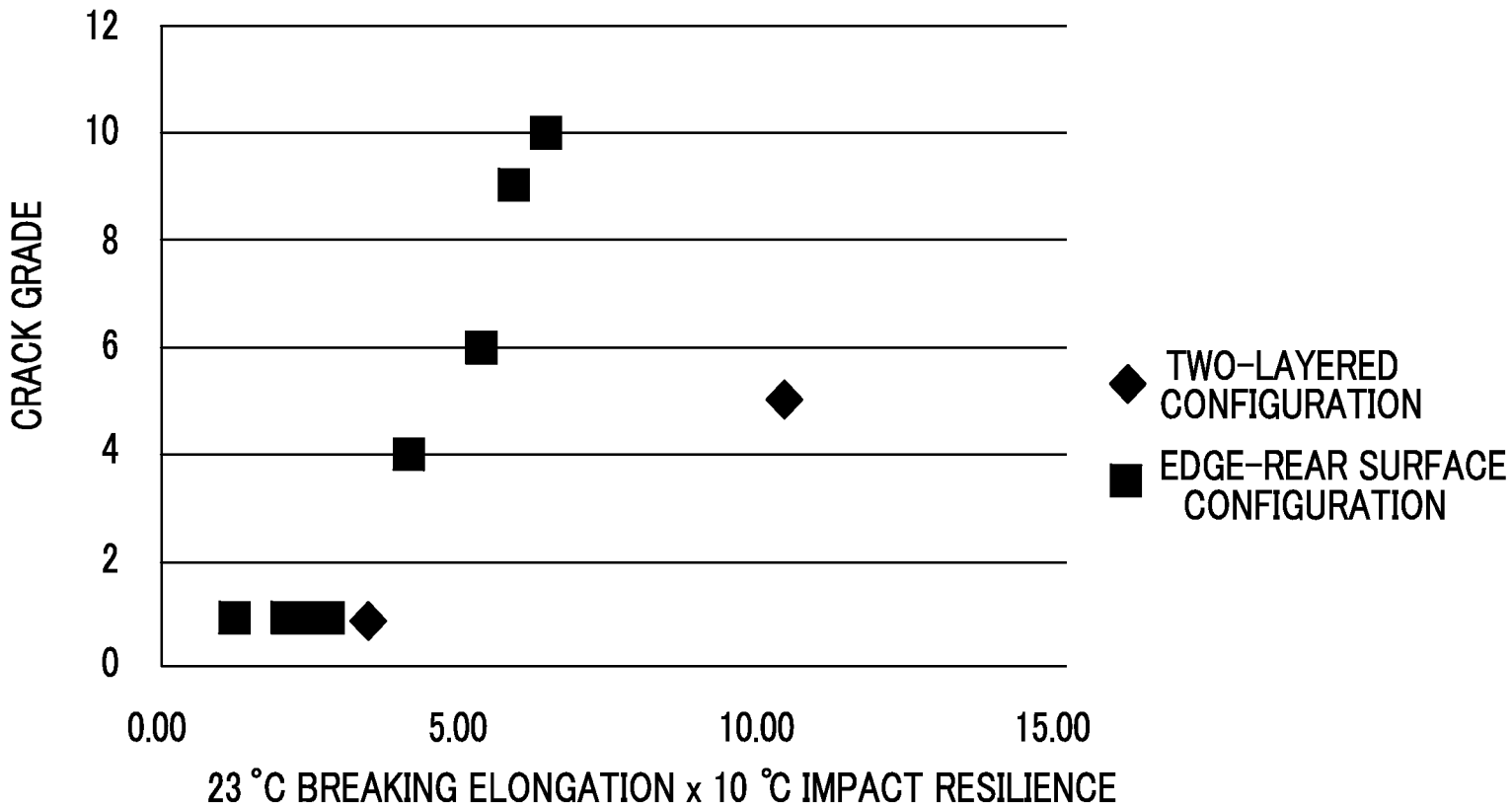
FIG. 17 is a graph showing a result of crack grades in Example B.
Figure 18:
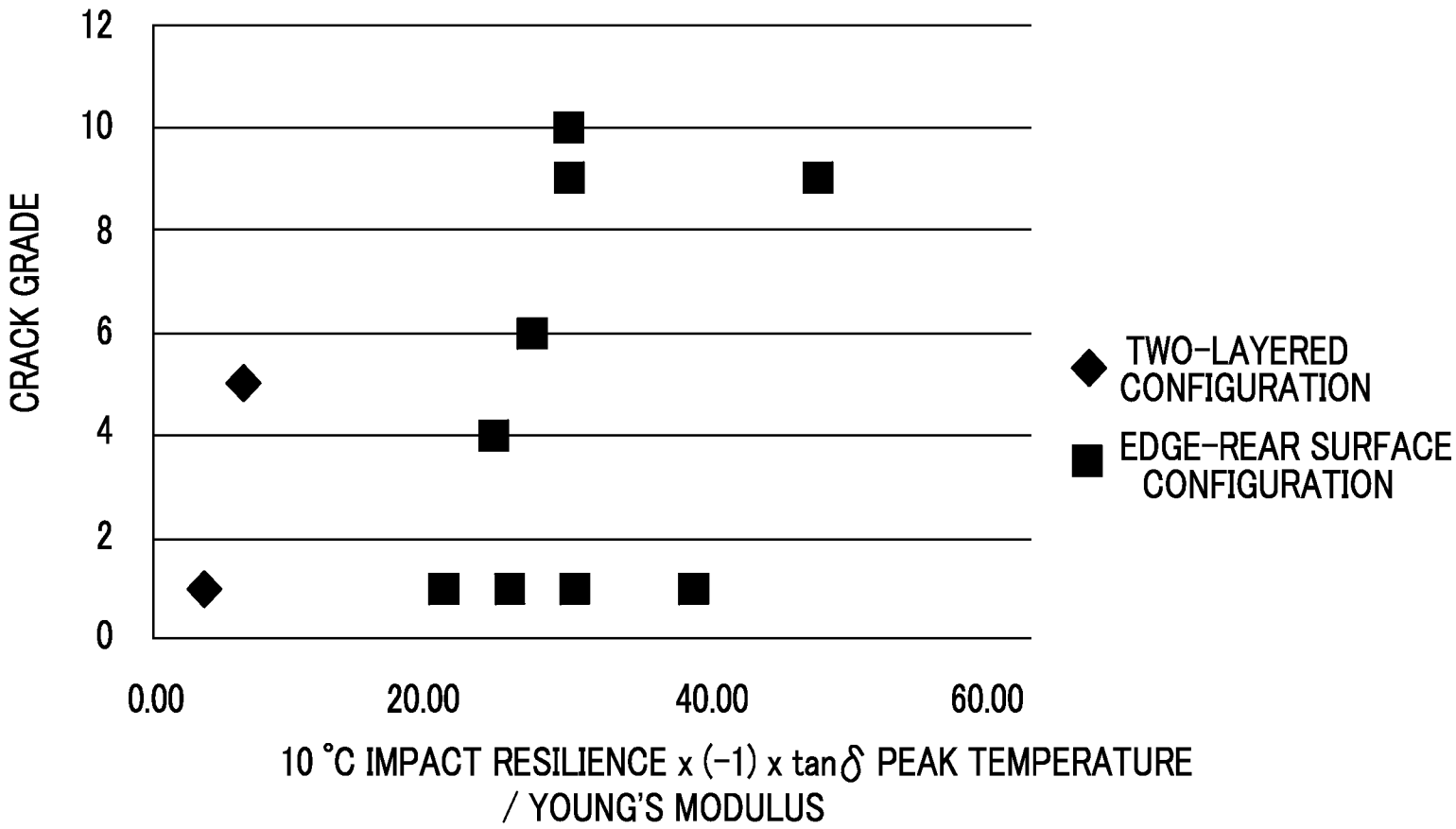
FIG. 18 is a graph showing a result of crack grades in Example B.
Figure 19:
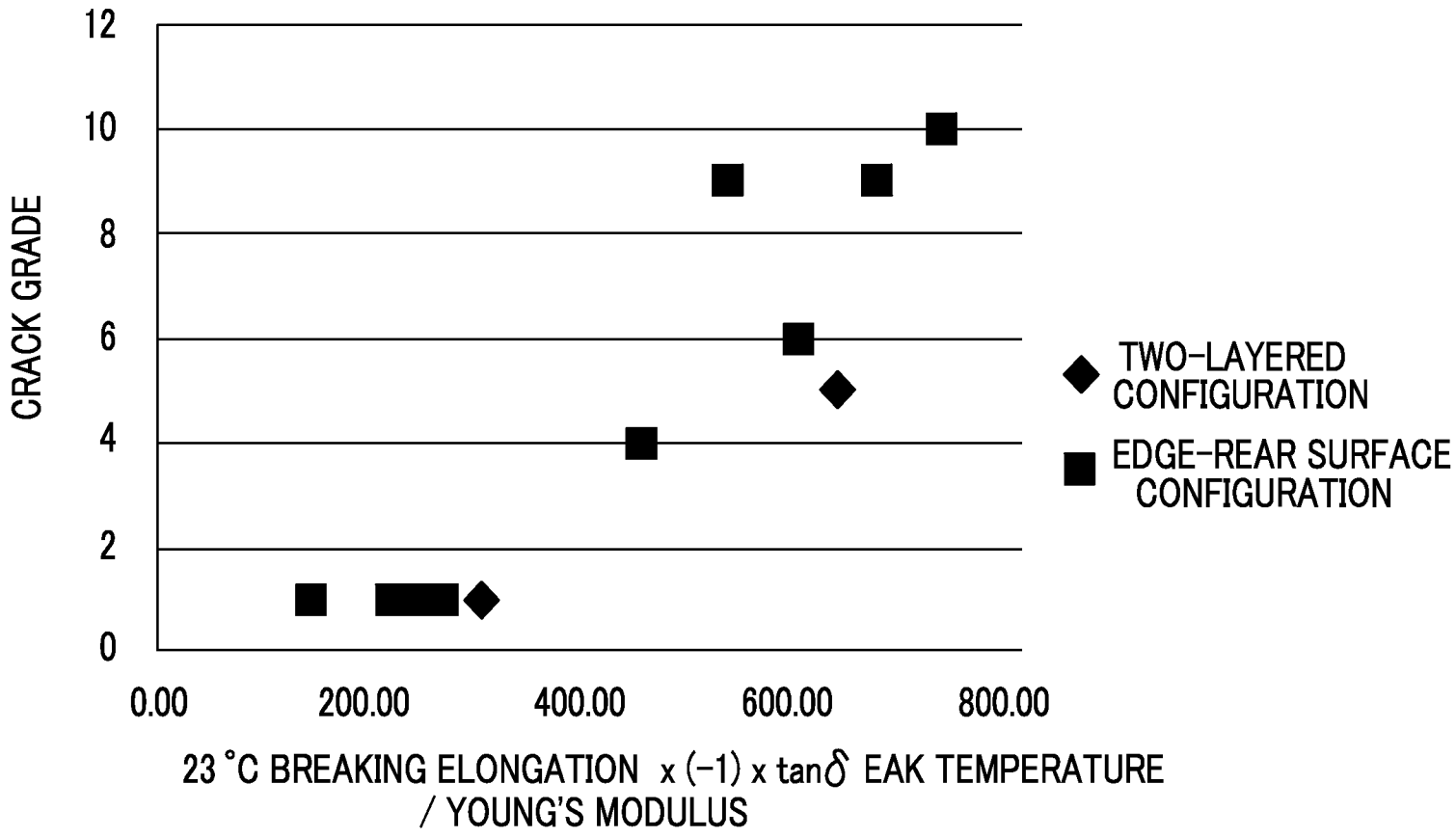
FIG. 19 is a graph showing a result of crack grades in Example B.

In addition, FIGS. 8 to 10 show relationships between another physical property value (10° C. impact resilience, (−1)×tan δ peak temperature, or Young's modulus) and the obtained results of crack grades in graphs. However, the result with correlation with the generation of cracks is not obtained.

In addition, FIGS. 11 to 19 show relationships between other two physical properties values (23° C. breaking elongation 10° C. impact resilience, 23° C. breaking elongation×(−1)×tan δ peak temperature, 23° C. breaking elongation/Young's modulus, 10° C. impact resilience×(−1)×tan δ peak temperature, and 10° C. impact resilience/Young's modulus) and three physical properties values (23° C. breaking elongation×10° C. impact resilience×(−1)×tan δ peak temperature, 23° C. breaking elongation×10° C. impact resilience/Young's modulus, 10° C. impact resilience×(−1)×tan δ peak temperature/Young's modulus, and 23° C. breaking elongation×(−1)×tan δ peak temperature/Young's modulus), and the obtained results of crack grades in graphs. However, the result with correlation with the generation of cracks is not obtained.

Figure 20:
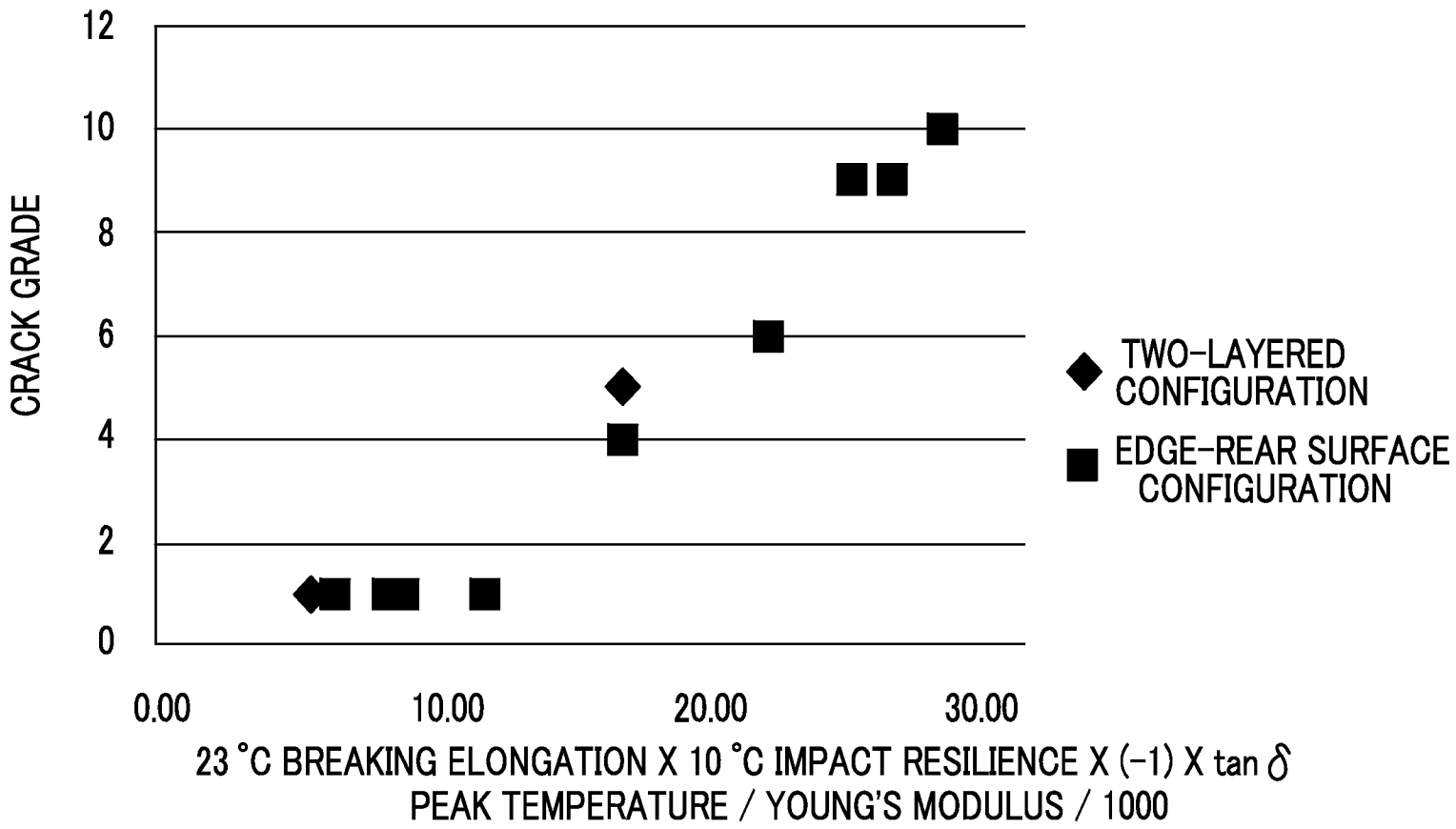
FIG. 20 is a graph showing a result of crack grades in Example B.

Meanwhile, FIG. 20 shows relationships between values of "23° C. breaking elongation×10° C. impact resilience×(−1)×tan δ peak temperature/Young's modulus" and the obtained results of crack grades in graph. As shown in FIG. 20, correlation with generation of cracks is obtained, and the crack generation for a cleaning blade which has a numerical value of the index K of equal to or more than 15 is efficiently suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade comprising:

at least a portion which comes in contact with a member to be cleaned is configured of a member having dynamic ultra micro hardness of from 0.25 to 0.65 and an index K acquired in the following Equation (1) of equal to or more than 15:

$$\text{index } K = [23^\circ\text{ C. breaking elongation (\%)}] \times [10^\circ\text{ C. impact resilience (\%)}] \times (-1) \times [\tan\delta \text{ peak temperature } (^\circ\text{ C.})] / [\text{Young's modulus (MPa)}] / 1000. \quad \text{Equation (1)}$$

2. The cleaning blade according to claim 1, comprising:

a contacting member that configures a region including at least a portion which comes in contact with the member to be cleaned; and a non-contacting member that configures a region other than the contacting member, is configured of a material different from that of the contacting member, and has impact resilience at 50° C. of equal to or less than 70%.

3. The cleaning blade according to claim 2, further comprising:

a contacting member that configures a region including at least a portion which comes in contact with the member to be cleaned; and a non-contacting member that configures a region other than the contacting member, is configured of a material different from that of the contacting member, and has 100% permanent elongation of equal to or less than 1.0%.

4. The cleaning blade according to claim 1, further comprising:

a contacting member that configures a region including at least a portion which comes in contact with the member to be cleaned; and a non-contacting member that configures a region other than the contacting member, is configured of a material different from that of the contacting member, and has 100% permanent elongation of equal to or less than 1.0%.

5. A cleaning device comprising the cleaning blade according to claim 1.

6. A process cartridge comprising:

the cleaning device according to claim 5, wherein the process cartridge is detachable from an image forming apparatus.

7. An image forming apparatus comprising:

an image holding member;

a charging device that charges the image holding member;

an electrostatic latent image forming device that forms an electrostatic latent image on a surface of a charged image holding member;

a developing device that develops the electrostatic latent image formed on the surface of the image holding member with toner to form a toner image;

a transfer device that transfers the toner image formed on the image holding member on a recording medium; and the cleaning device according to claim 5 that brings the cleaning blade into contact with the surface of the image holding member after the transfer of the toner image by the transfer device for cleaning.

* * * * *